United States Patent [19]

Chan et al.

[11] Patent Number: 5,054,984

[45] Date of Patent: Oct. 8, 1991

[54] BINDING LINE BOOK TRACKING SYSTEM AND METHOD

[75] Inventors: Wai-Kwong Chan, Chicago; Mary F. Allsopp, Glen Ellyn, both of Ill.; Peter A. Brandt; Robert R. Butler, both of Glasgow, Ky.; Kevin T. McGuire, Aurora, Ill.; Thomas R. Miller, Chicago, Ill.; Robert W. Nonnemann, Batavia, Ill.; Gordon A. Obrecht, Lisle, Ill.; Ronald B. Saluski, Bolingbrook, Ill.; Michael W. Shircliff; Samuel A. Walker, both of Glasgow, Ky.

[73] Assignee: R. R. Donnelley & Sons Company, Chicago, Ill.

[21] Appl. No.: 593,475

[22] Filed: Oct. 2, 1990

Related U.S. Application Data

[63] Continuation of Ser. No. 321,012, Mar. 9, 1989, abandoned.

[51] Int. Cl.[5] ..... B42C 1/12

[52] U.S. Cl. ..... 412/001; 270/54; 270/58; 364/464.02; 364/464.03; 412/11; 412/12

[58] Field of Search ..... 270/54, 58; 364/464.02, 364/464.03, 466, 478; 412/1, 11, 12

[56] References Cited

U.S. PATENT DOCUMENTS

| | | | |
|---|---|---|---|
| Re. 29,105 | 1/1977 | Miaskoff et al. | 412/12 |
| Re. 32,690 | 6/1988 | Wong | 364/464.02 |
| 2,708,760 | 5/1955 | Pearce | 412/12 |
| 3,718,939 | 3/1973 | Mebus | 412/12 X |
| 3,804,404 | 4/1974 | Bosshard | 412/11 X |
| 4,121,818 | 10/1978 | Riley et al. | 364/478 X |
| 4,429,795 | 2/1984 | Hawkes | 412/12 X |
| 4,674,052 | 6/1987 | Wong et al. | 364/464.03 |
| 4,797,830 | 1/1989 | Baggarly et al. | 364/464.03 |

FOREIGN PATENT DOCUMENTS

| | | | |
|---|---|---|---|
| 2502547 | 1/1982 | France | 412/11 |

*Primary Examiner*—Paul A. Bell

*Attorney, Agent, or Firm*—Wood, Phillips, Mason, Recktenwald & Vansanten

[57] ABSTRACT

A binding line including at least first and second binding line sections. The first binding line section is adapted to transport books therealong to a book exit station and the second binding line section is adapted to transport books therealong from a book entry station. The binding line includes a book transferring mechanism or subsystem for moving books from the book exit station of the first binding line section to the book entry station of the second binding line section as well as devices associated with book leaving the book exit station and books entering the book entry station for tracking books during transfer from the first binding line section to the second binding line section. The first binding line section can run at the same or a different speed than the second binding line section. In addition, the binding line can include asynchronous or synchronous multiple first and/or second binding line sections.

103 Claims, 15 Drawing Sheets

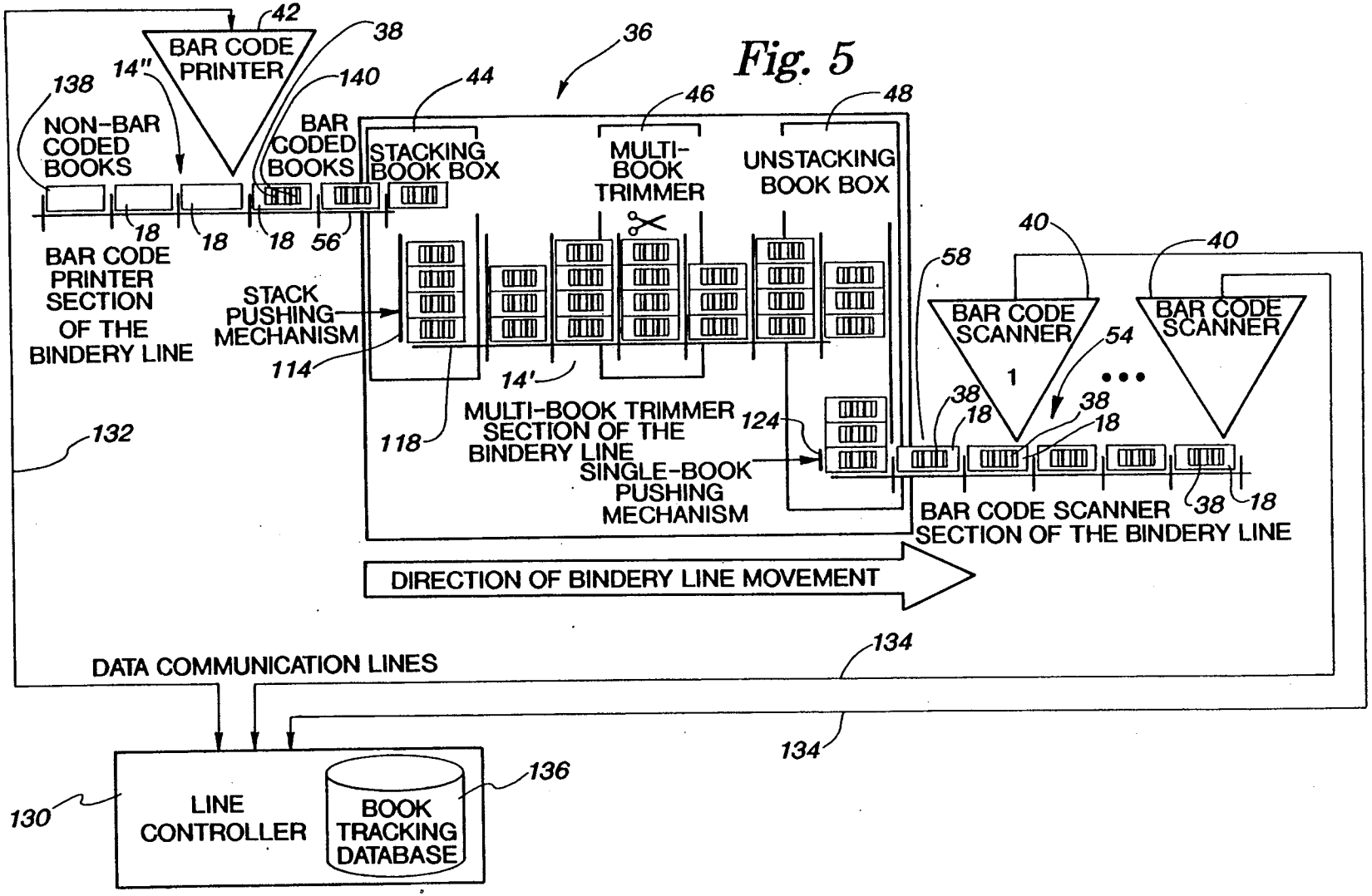
BAR CODE SCANNER
BAR CODE SCANNER
BAR CODE SCANNER SECTION OF THE BINDERY LINE
UNSTACKING BOOK BOX
MULTI-BOOK TRIMMER
STACKING BOOK BOX
MULTI-BOOK TRIMMER SECTION OF THE BINDERY LINE
SINGLE-BOOK PUSHING MECHANISM
DIRECTION OF BINDERY LINE MOVEMENT
BAR CODED BOOKS
STACK PUSHING MECHANISM
BAR CODE PRINTER
NON-BAR CODED BOOKS
BAR CODE PRINTER SECTION OF THE BINDERY LINE
DATA COMMUNICATION LINES
BOOK TRACKING DATABASE
LINE CONTROLLER
Fig. 5

A
WAIT FOR BOOK DETECTOR SIGNAL
62
76
ERROR
A
SIGNAL VALID?
64
YES
66
BOOK IN CHAIN SPACE?
YES
68
70
PROCESS CCB THROUGH REORDER
MOVE CCB INTO FIFO
74
72
ERROR
YES
EXCEEDED FIFO HIGH WATER MARK?
A
A

78
WAIT FOR CHAIN TO ADVANCE ONE SPACE
80
VALID BOOK DETECTOR SIGNAL RECORDED?
YES
82
ERROR

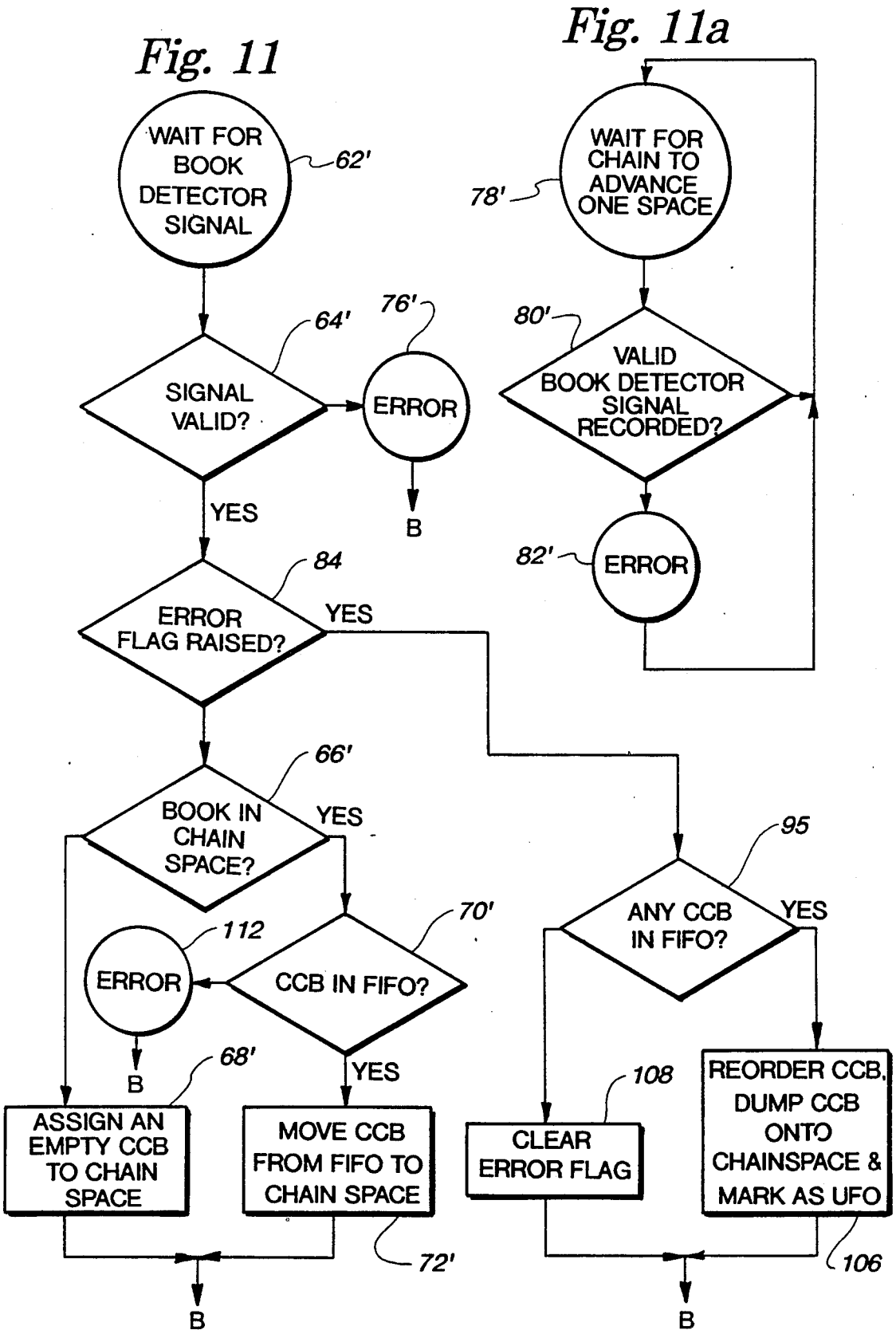
Fig. 11
WAIT FOR BOOK DETECTOR SIGNAL
62'
SIGNAL VALID?
64'
ERROR
76'
B
YES
ERROR FLAG RAISED?
84
YES
BOOK IN CHAIN SPACE?
66'
YES
ERROR
112
CCB IN FIFO?
70'
B
YES
ASSIGN AN EMPTY CCB TO CHAIN SPACE
68'
MOVE CCB FROM FIFO TO CHAIN SPACE
72'
B
Fig. 11a
WAIT FOR CHAIN TO ADVANCE ONE SPACE
78'
VALID BOOK DETECTOR SIGNAL RECORDED?
80'
ERROR
82'
ANY CCB IN FIFO?
95
YES
CLEAR ERROR FLAG
108
REORDER CCB, DUMP CCB ONTO CHAINSPACE & MARK AS UFO
106
B

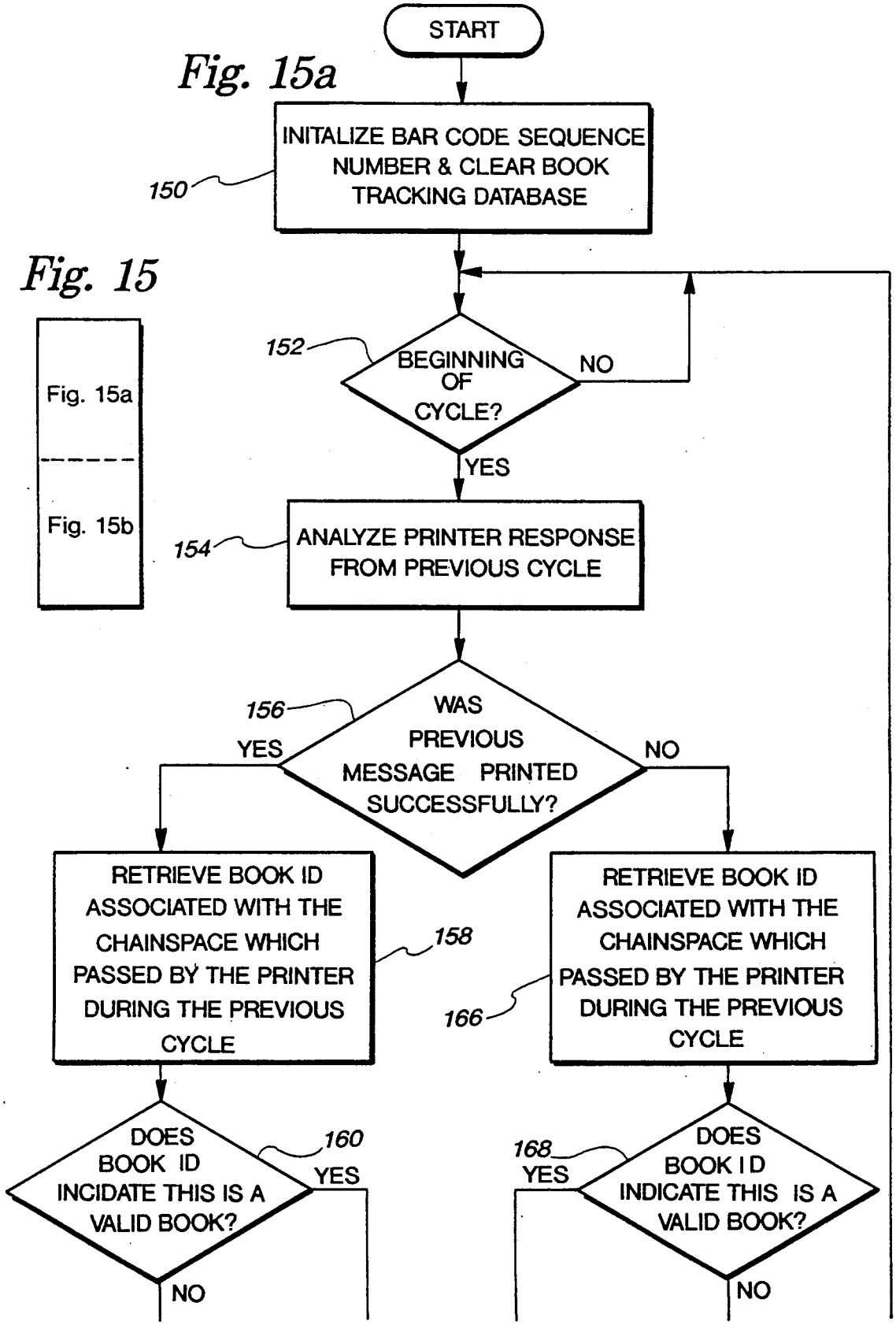
START
Fig. 15a
INITALIZE BAR CODE SEQUENCE NUMBER & CLEAR BOOK TRACKING DATABASE
150
Fig. 15
Fig. 15a
Fig. 15b
152
BEGINNING OF CYCLE?
NO
YES
154
ANALYZE PRINTER RESPONSE FROM PREVIOUS CYCLE
156
WAS PREVIOUS MESSAGE PRINTED SUCCESSFULLY?
YES
NO
RETRIEVE BOOK ID ASSOCIATED WITH THE CHAINSPACE WHICH PASSED BY THE PRINTER DURING THE PREVIOUS CYCLE
158
RETRIEVE BOOK ID ASSOCIATED WITH THE CHAINSPACE WHICH PASSED BY THE PRINTER DURING THE PREVIOUS CYCLE
166
DOES BOOK ID INCIDATE THIS IS A VALID BOOK?
160
YES
NO
168
DOES BOOK I D INDICATE THIS IS A VALID BOOK?
YES
NO

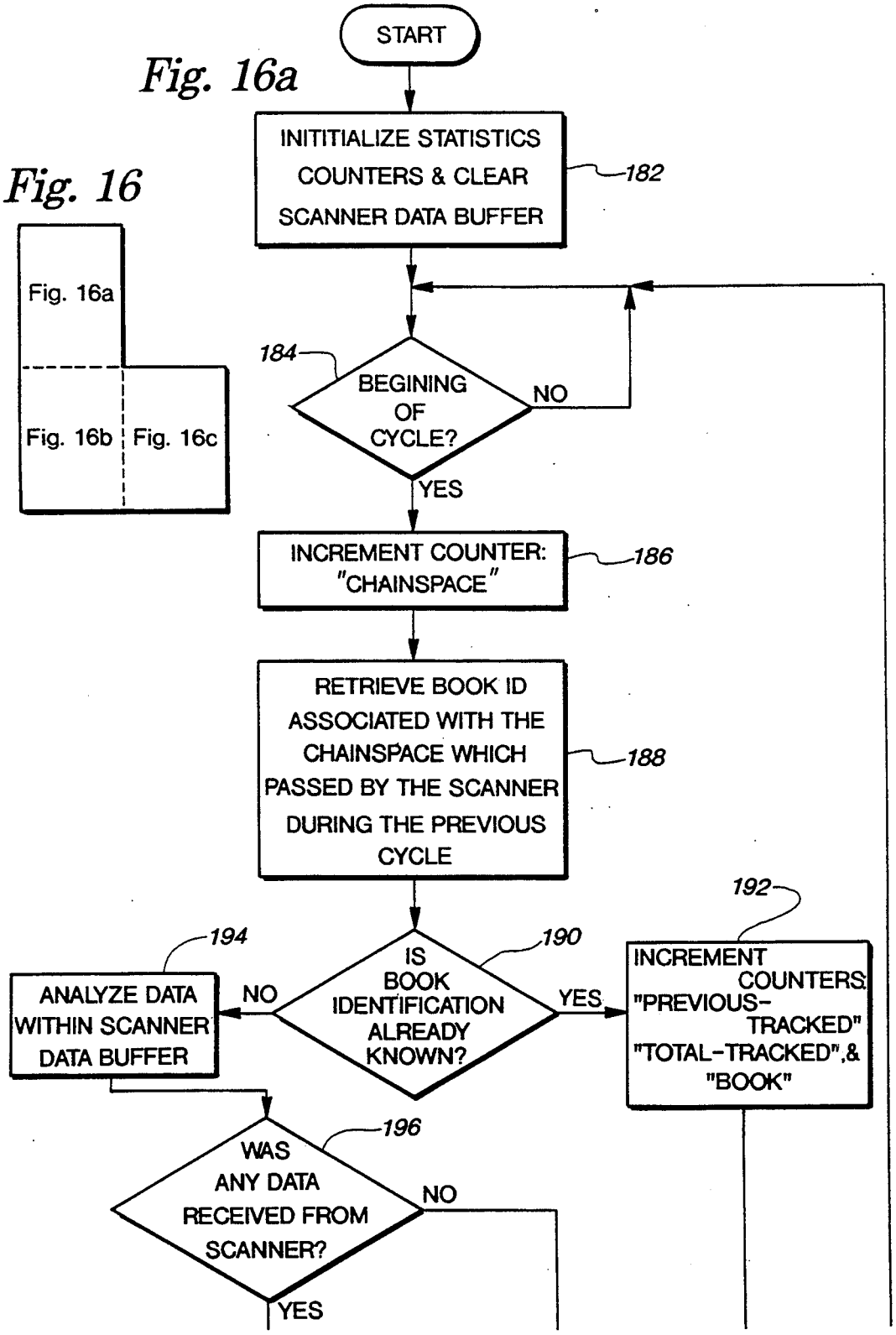
START
Fig. 16a
INITITIALIZE STATISTICS COUNTERS & CLEAR SCANNER DATA BUFFER
182
Fig. 16
Fig. 16a
Fig. 16b
Fig. 16c
184
BEGINING OF CYCLE?
NO
YES
INCREMENT COUNTER: "CHAINSPACE"
186
RETRIEVE BOOK ID ASSOCIATED WITH THE CHAINSPACE WHICH PASSED BY THE SCANNER DURING THE PREVIOUS CYCLE
188
192
194
190
IS BOOK IDENTIFICATION ALREADY KNOWN?
NO
YES
ANALYZE DATA WITHIN SCANNER DATA BUFFER
INCREMENT COUNTERS: "PREVIOUS-TRACKED" "TOTAL-TRACKED",& "BOOK"
196
WAS ANY DATA RECEIVED FROM SCANNER?
NO
YES

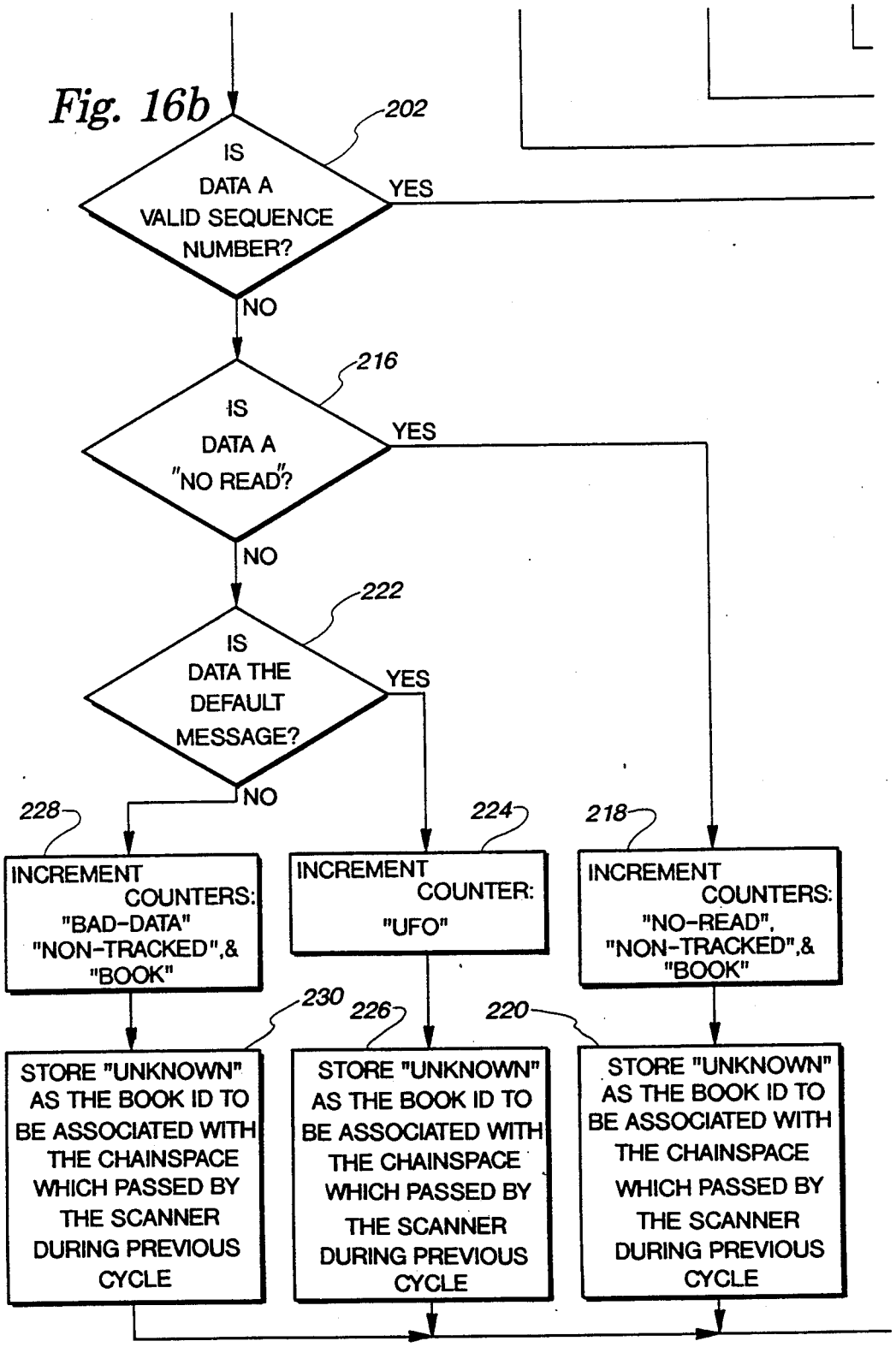
Fig. 16b
202
IS DATA A VALID SEQUENCE NUMBER?
YES
NO
216
IS DATA A "NO READ"?
YES
NO
222
IS DATA THE DEFAULT MESSAGE?
YES
NO
228
INCREMENT COUNTERS: "BAD-DATA" "NON-TRACKED",& "BOOK"
224
INCREMENT COUNTER: "UFO"
218
INCREMENT COUNTERS: "NO-READ", "NON-TRACKED",& "BOOK"
230
STORE "UNKNOWN" AS THE BOOK ID TO BE ASSOCIATED WITH THE CHAINSPACE WHICH PASSED BY THE SCANNER DURING PREVIOUS CYCLE
226
STORE "UNKNOWN" AS THE BOOK ID TO BE ASSOCIATED WITH THE CHAINSPACE WHICH PASSED BY THE SCANNER DURING PREVIOUS CYCLE
220
STORE "UNKNOWN" AS THE BOOK ID TO BE ASSOCIATED WITH THE CHAINSPACE WHICH PASSED BY THE SCANNER DURING PREVIOUS CYCLE

BINDING LINE BOOK TRACKING SYSTEM AND METHOD

This application is a continuation of application Ser. No. 321,012, filed Mar. 9, 1989 now abandoned.

FIELD OF THE INVENTION

The present invention relates to binding lines and, more particularly, to a binding line book tracking system and method.

BACKGROUND OF THE INVENTION

The signatures that make up a book are fed to the binding line by feeder devices of a particular type or types. Typically, these feeder devices comprise what are referred to as packer boxes, but the line may also include one or more card feeders for inserts, and will usually include at least one cover feeder to feed covers for the book. As will be appreciated, the composition of the book can be varied by the selective activation of these feeder devices.

In addition to customizing the composition of the book, address labels, personalized messages and other graphics can be printed onto the pages of a book on the binding line by utilizing ink jet printers. To further customize the book, the selection of print location and the print content can be specified by code in accordance with the teachings of commonly owned U.S. Pat. No. 4,121,818. At the end of the binding line, books can be bundled by mail route in order to maximize postal discounts since the production order at the binding line will typically have been presorted by zip code for this purpose.

Of course, it will be appreciated that defective books that must be reordered, i.e., remade, should also be properly bundled at the end of the binding line. This can be handled in accordance with the teachings of commonly owned U.S. Pat. Nos. Re. 32,690 and 4,674,052 which take into account that each book on the line can have a unique combination of characteristics including composition, ink jetted image and mail bundle. Because of this fact, the action of a binding line device is dictated at any machine cycle by the unique characteristics of the book currently at that device.

Currently known saddle-wire binding lines can accurately be characterized as fully synchronized assembly lines. A slotted conveyor chain carries a book past stationary binding line devices which operate on the chainspaces that are directly under their respective positions at any point in time, e.g., they may drop a signature onto the chainspace or print a message onto the book riding on the chainspace. As a result, the operations of all stationary binding line devices are synchronized to the motion of the chain.

As a practical matter, multiple conveyor chains are typically used to transport a book through such a binding line. However, the drive shafts of all such conveyor chains are fully coupled to effectively produce a single continuous chain loop.

In a typical saddle-wire binding line, the continuous chain loop is divided into chainspaces by what are known as push pins. As the chain conveyor moves, chainspaces can be described as being "created" at the head of the binding line, driven through the binding line by the drive shaft, and "expelled" at the end of the binding line; thus, during its "life span" in the binding line, a chainspace serves to carry a single book. In this connection, a book is positively confined to a single chainspace as it passes through the binding line.

Thus, the characteristics of a continuous chain loop are such that the distance a book moves is derivable from the rotation of the drive shaft. This follows from the fact that the chain is driven by the drive shaft and, as a result, a binding line may, by way of example, be geared such that each revolution of the drive shaft advances the chain by one chainspace. Accordingly, the position of a book on a binding line can be determined by measuring the number of machine cycles, i.e., drive shaft revolutions.

In other words, the continuity of the chain allows the position of a particular chainspace at any point in time to be derived from drive shaft rotation. From this, and considering the positive confinement of a book to a particular chainspace, the position of a book can be mapped to the position of its chainspace, a technique known as indirect book tracking. However, since such a binding line is locked to one drive shaft, the entire line must be stopped to interrupt the operation of any single device.

For this reason, it would be desirable to be able to utilize multiple conveyors to transport books through a binding line where the chains of the conveyors were decoupled to permit independent operation. It will be appreciated that the decoupling of conveyor chains would offer a major advantage; namely, upstream, or first, conveyor chain sections (in the direction of flow) could be stopped without affecting the operation of downstream, or second, sections. In a perfect binding line, the ability to stop the gathering section without affecting the binder section would reduce production waste due to the cooling of binder glue that would otherwise result in so-called "cold back books."

For this purpose, the gathering and binder sections could each be modeled as an independent continuous chain wherein each of the independent continuous chains has the characteristic of positive book confinement. It would not be possible, however, for the transfer mechanism that would be required to transport books from the gathering chain to the binder chain, whether it take the form of a mechanical conveyor or any other means of transferring books from one point to another, to be modeled in a similar fashion. As a result, the previously described simple method of deriving book position from drive shaft rotation cannot be applied and a method is required that can track and identify books independent of the transfer mechanism.

In addition, it may be desirable to handle a multiple number of books in one or more devices of a binding line which render it a practical impossibility to allow for the direct association of one unique book to any particular chainspace. For instance, and by way of example only, a stacking trimmer subsystem which typically includes multi-book trimmer blades together with associated stacking and unstacking devices has been so recognized inasmuch as such a subsystem permits a multiple number of books to be trimmed concurrently within the subsystem. In this connection, a stacking trimmer subsystem has its constituent components operating in concert whereby a series of individual books is stacked, a multiple number of books in the series is concurrently trimmed, and the books are unstacked to be returned as a series of individual books in the same order as the books were originally received.

For such applications, the stacking device will be positioned upstream of the multi-book trimmer and the unstacking device will be positioned downstream of the multi-book trimmer. Again, it will be understood that "upstream" and "downstream" have reference to the direction of flow of books on the binding line. Clearly, a stacking trimmer subsystem precludes tracking books by associating the identification of each book with a chainspace on which it resides as in normal processing on the binding line.

Specifically, the stacking device will typically be used to transform a series of individual books into a multiple number of books which are stacked directly on top of each other. This means that the subsystem would allow for the entire stack to be trimmed concurrently rather than requiring individual trimming of each individual book. Reciprocally, the unstacking device will typically be used to transform the books which are stacked directly on top of each other back into a series of individual books after the trimming operation.

As will be appreciated, the currently employed method of tracking books can be used for the portion of the binding line immediately upstream of the stacking device since a direct association can be made between each chainspace and a unique book. This book tracking method can also be used for the portion of the binding line immediately downstream of the unstacking device provided that the identification of each book can be determined as the books are removed from the stack. If the stacking and unstacking devices operated perfectly and there was never any spoilage in the trimmer, then a first-in, first-out tracking sequence could be used to determine the identification of the books as they are removed from the stack.

However, mishaps do occur in the stacking and unstacking mechanisms and spoilage or damage does occur occasionally in the trimming process. This may cause the series of books to become rearranged out of the first-in, first-out tracking sequence or for one or more of the books to become lost entirely. Therefore, a first-in, first-out tracking sequence may not be economically feasible for identification of books as they traverse the subsystem.

The present invention is directed to overcoming the foregoing problems and accomplishing the resulting objects by providing a unique binding line book tracking system.

SUMMARY OF THE INVENTION

It is a principal object of the present invention to provide a binding line book tracking system and method. It is also an object of the present invention to provide such a binding line book tracking system and method wherein means are provided for transferring books from a first binding line section to a second binding line section together with means for tracking the books as they are transferred. It is a further object of the present invention to provide an asynchronous multi-section binding line.

Accordingly, the present invention is directed to a binding line comprising first and second binding line sections. The first binding line section includes means for transporting books therealong to a book exit station and the second binding line section includes means for transporting books therealong from a book entry station. Means are provided for transferring books from the book exit station of the first binding line section to the book entry station of the second binding line section and, for tracking books through time and space, means associated with books leaving the book exit station and books entering the book entry station are also provided. The first binding line section may suitably be one or more gathering sections and the second binding line section may suitably be one or more binder sections. Alternatively, the first binding line section may suitably be a binder section and the second binding section may be a mail table section.

In an exemplary embodiment, the book transferring means may include a conveyor extending from the book exit station to the book entry station. For tracking the books through the conveyor or other book transferring means, it is also contemplated that the book tracking means will include either detection means at the book exit station and at the book entry station which are electronically linked to a line controller and operate in a first-in, first-out (FIFO) manner, or intrinsic book identification means associated with each of the books at or upstream of the book exit station to provide a separate identification therefor together with means for identifying the intrinsic book identification means at or downstream of the book entry station. In the latter case, the intrinsic book identification means preferably comprises a code and the identifying means preferably includes code reading means.

Additional details of the present invention include error detection means associated with the first and second binding line sections, the book transferring means and the book tracking means. Preferably, the error detection means includes means for detecting a mechanical error in the book transferring means as well as means for detecting an electronic error in the book tracking means. Upon detecting either a mechanical error or an electronic error, the respective error detection means stop the book transporting means of the first and second binding line sections.

For purposes of error detection in the present invention, among the mechanical error detection means that may be utilized are a book jam detector, a transfer book removal detector, and a transfer housing-opened detector. Among the electronic error detection means that may be utilized are electronic tracking overflow and underflow detectors, a missing book eye signal detector, and an inconsistent book eye signal detector.

While the present invention is well suited to asynchronous binding line sections, the first binding line section can nevertheless be synchronously related to the second binding line section. It should also be noted that the unique features of the binding line allow the first binding line section to run at a different speed than the second binding line section, preferably a lower speed, although they may run at the same speed; in fact, the first binding line section can even temporarily run at a greater speed than the second binding line section depending upon the physical and operational characteristics of the book transferring means. In some cases, the binding line may also include yet a third binding line section having means for transporting books therealong from a book entry station to a book exit station thereof.

With that configuration, the binding line will preferably include a first mechanical means for transferring books from the book exit station of the first binding line section to the book entry station of the second binding line section. It will also be appreciated that the binding line will advantageously include a second mechanical mean for transferring books from a book exit station of the second binding line section to the book entry station of the third binding section. It will further be appreciated that respective electronic book tracking means will advantageously be associated with books at each of the book transfer points for tracking books through the respective mechanical book transferring means. In a preferred embodiment, the first binding line section is a gathering section, the second binding line section is a binder section, and the third binding line section is a mail table section.

In addition, the present invention is directed to a method of tracking books in a binding line having first and second binding line sections. The method includes the steps of transporting books along the first binding line section to a book exit station, transferring books from the book exit station of the first binding line section to a book entry station of the second binding line station, and tracking books leaving the book exit station and books entering the book entry station through time and space. Further, the method includes the step of transporting books along the second binding line section from the book entry station.

Still other objects, advantages and features of the present invention will become apparent from a consideration of the following specification taken in conjunction with the accompanying drawings.

BRIEF DESCRIPTION OF THE DRAWINGS

FIG. 5 is a model view or logical representation of book tracking for the stacking trimmer subsystem of FIG. 4;

FIG. 11 is a logic diagram of tasks at or downstream of an entry point of a downstream section of the binding line of FIG. 1;

FIG. 11*a* is a logic diagram of a concurrent operation at or downstream of the entry point of the downstream section of the binding line of FIG. 1;

FIGS. 15, 15*a* and 15*b* are a logic diagram of a bar code printer control.

DETAILED DESCRIPTION OF THE PREFERRED EMBODIMENT

Figure 1:
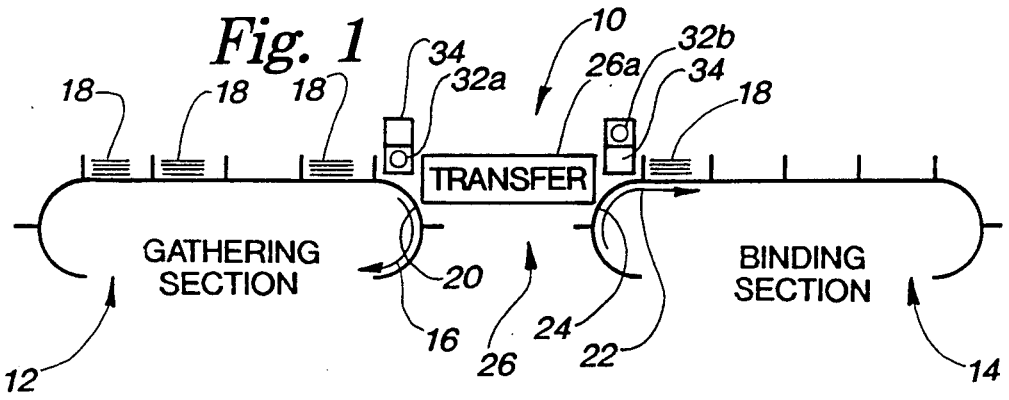
FIG. 1 is a mechanical schematic side elevational view of a binding line having two sections.
Figure 2:
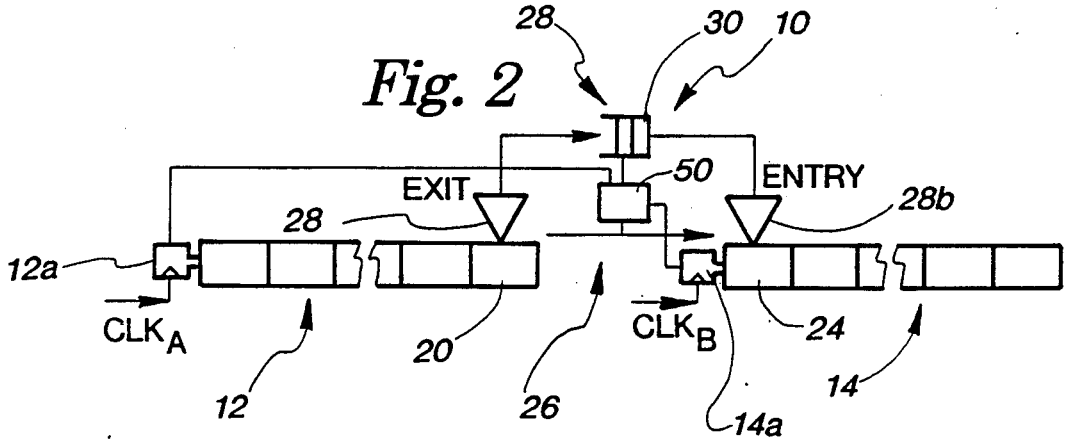
FIG. 2 is a model view or logical representation of book tracking for the binding line of FIG. 1.

Referring to the drawings, and first to FIGS. 1 and 2, the present invention is directed to a binding line which includes a first binding line section 12 and a second binding line section 14. The first binding line section 12 includes means such as a continuous chain loop 16 for transporting books 18 therealong to a book exit station 20 and the second binding line section 14 includes means such as a continuous chain loop 22 for transporting books 18 therealong from a book entry station 24. It will also be seen that the binding line 10 includes means such as a mechanical conveyor generally designated 26 for transferring books 18 from the book exit station 20 of the first binding line section 12 to the book entry station 24 of the second binding line section 14 and, for tracking books 18 through the book transferring means (in the illustrated example, the mechanical conveyor 26) and, thus, through time and space, means such as an electronic detection system generally designated 28 is operatively associated with books 18 leaving the book exit station 20 and books 18 entering the book entry station 24. The first binding line section 12 (which may by way of example be a gathering section) may be either asynchronously or synchronously related to the second binding line section 14 (which may by way of example be a binder section). Furthermore, the binding line 10 is such that the first binding line section 12 may run at either the same speed, or a different speed, and preferably a lower speed than the second binding line section 14 during the course of operation thereof.

In fact, the first binding line section 12 can even run temporarily at a greater speed than the second binding line section 14. This will depend, of course, upon the physical and operational characteristics of the book transferring means, whether it be a mechanical conveyor 26 or any other form of book transfer such as, by way of example, a shingling device, a pile off station or an intermediate storage device (none of which have been shown but all of which will be known to those skilled in the art). Clearly, the required characteristics for this operating condition will be apparent to those skilled in the art.

In the embodiment illustrated in FIGS. 1 and 2, there is a single first binding line section 12 and a single second binding line section 14 making up the binding line 10. It should be understood and appreciated that the binding line 10 can comprise an asynchronous multi-section binding line in which case there will be at least one first binding line section 12 and at least one second binding line section 14. Thus, by using appropriate book stream merge and/or split devices (which are known to those skilled in the art), there could be two or more of the respective first and/or second binding line sections. It should further be understood and appreciated that each of the binding line sections 12 and 14 will have means in the form of a continuous chain loop such as 16 and 22 for transporting books therealong in the manner discussed. In addition, while described as a gathering section 12 and a binder section 14, 20 the first binding line section could, for example, be a binder section with the second binding line section comprising a mail table section.

Figure 3:
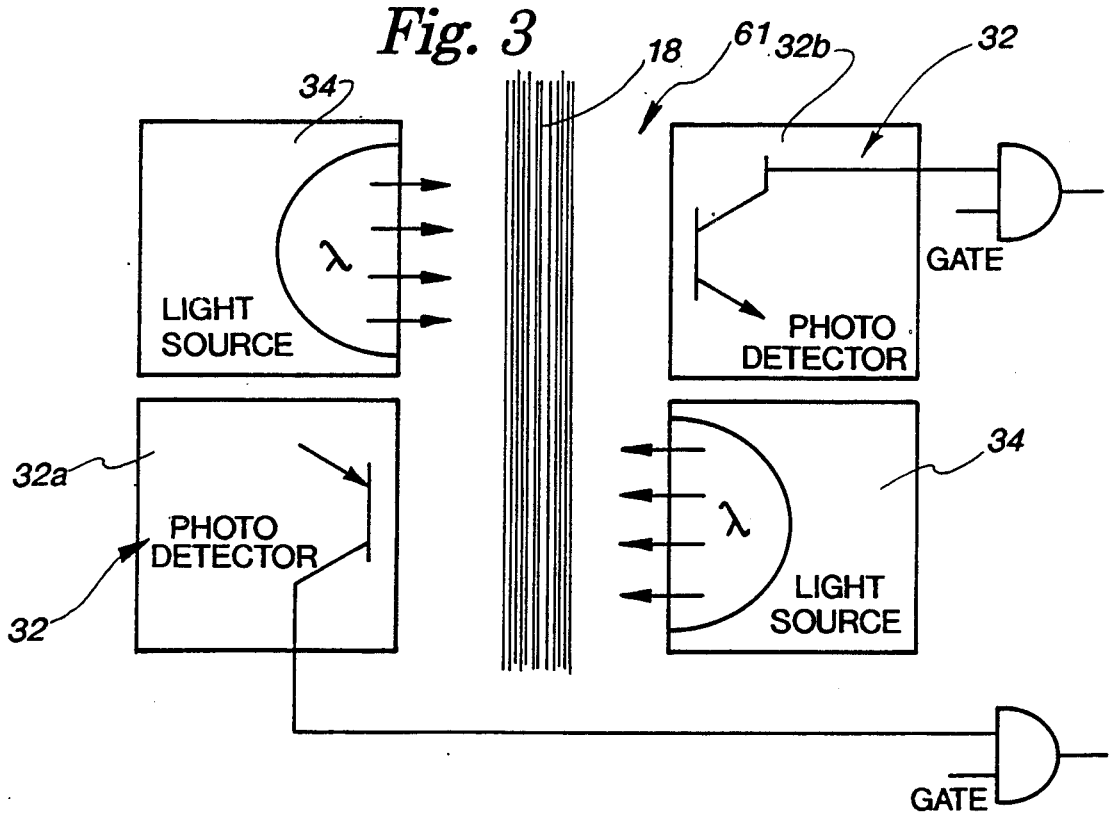
FIG. 3 is a mechanical schematic front elevational view of a book detector for the binding line of FIG. 1.

As shown in FIG. 1, the mechanical conveyor 26 extends from the book exit station 20 to the book entry station 24 for conveying books 18 therebetween. It will also be seen that the electronic book tracking means or system generally designated 28 preferably comprises a photo book detector system generally designated 61 at the book exit station 20 and a photo book detector system generally designated 61 at the book entry station 24, both of which are electronically linked through an internal first-in, first-out (FIFO) buffer 30 to track books 18 through time and space and, thus, through the mechanical book transferring means or conveyor 26 in the illustrated embodiment in a FIFO manner. Preferably, the photo book detector systems generally designated 61 each comprise a pair of photoeyes 32 having complementary outputs arranged in a cross-firing pattern as illustrated in FIG. 3.

As there shown, the photoeyes 32 are arranged on opposite sides of the path of travel of a book 18 with corresponding light sources 34 being provided directly opposite each of the photoeyes 32. In this manner, the outputs of a corresponding pair of photoeyes 32 located at either the book exit station 20 or the book entry station 24 is such that one of the photoeyes such as 32*a* has a low output and the other of the photoeyes such as 32*b* has a high output when blocked, i.e., when the book 18 blocks light from the respective light sources 34. With this arrangement, the cross-firing photoeyes 32 located at the book exit station 20 and at the book entry station 24 provide high reliability, redundant book detectors.

Referring to FIG. 1, the first binding line section 12 and the second binding line section 14 can be any two sections of a binding line 10. Thus, the book transferring means, which has been illustrated as a mechanical conveyor for explanatory purposes only, may actually comprise any of a wide variety of book transferring or handling devices or mechanisms. When such device or mechanism is one where there may not necessarily be one unique book for any given chainspace, precise tracking of individual books may be desired.

Figure 4:
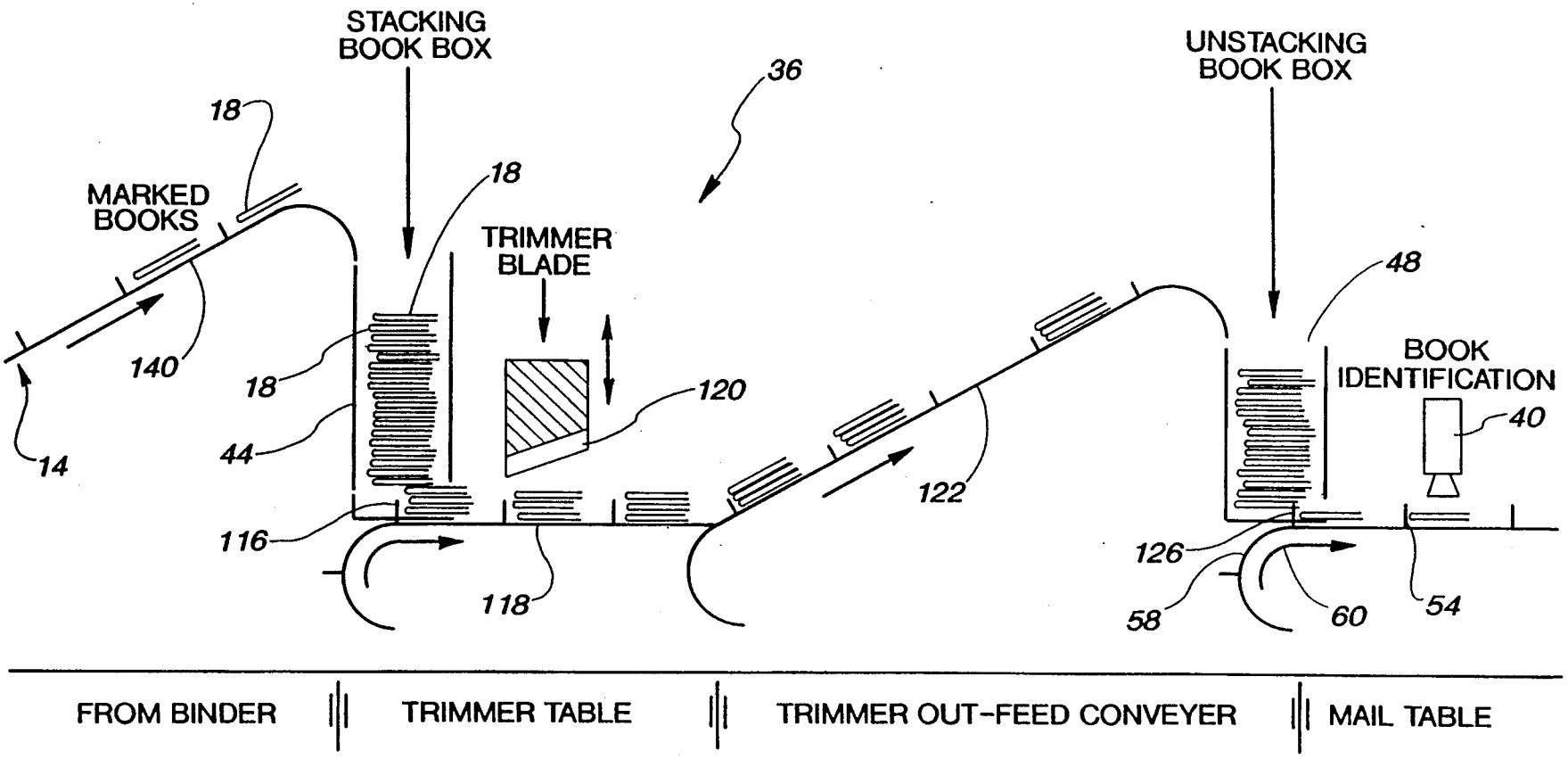
FIG. 4 is a mechanical schematic side elevational view of a stacking trimmer subsystem for a binding line.

More specifically, when the "first" or "upstream" binding line section is a binder section such as 14 and the "second" or "downstream" binding line section is a mail table section such as 54, the mechanical conveyor 26 may be replaced, e.g., by a stacking trimmer subsystem generally designated 36 (see FIG. 4). In such an application, as well as any application in which it is desired to precisely track individual books rather than rely on a FIFO tracking system or sequence, the electronic book tracking means or system (which has generally been designated 28 in the embodiment illustrated in FIG. 2) may take the form of intrinsic book identification means such as a code or symbology, e.g., a bar code 38, which has been applied by means such as a bar code printer 42 and which is associated with each of the books 18 to provide a separate identification therefor (see, also, FIG. 5). If intrinsic book identification is utilized, the electronic book tracking means or system will further include means for reading the code or symbology such as a bar code scanner 40 at the book entry station 58 of the "second" or "downstream" section, i.e., the mail table section 54.

As for the stacking trimmer subsystem 3 illustrated in FIG. 5, the bar code printer 42 will then be provided to print the bar code 38 on the books 18 at or upstream of the book exit station 56 of the "first" or "upstream" section, i.e., the binder section 14″. Thus, the books 18 would have the bar code 38, or other machine readable code or symbology, imprinted thereon prior to entering the stacking trimmer subsystem 36 and the bar code scanner 40, or other code or symbology reading or identifying device, would be located at or downstream of the book entry station 58 of the "second" or "downstream" section, i.e., the mail table section 54. With this arrangement, it is possible to track books 18 despite passage through, e.g., a stacking book box 44, multi-book trimmer blades 46, and an unstacking book box 48.

Referring once again to the embodiment illustrated in FIGS. 1 and 2, an error detection system 50 is preferably associated with the mechanical transfer 26, the electronic book tracking means or system 28 and the first and second binding line sections 12 and 14. The error detection system 50 which also serves as a line controller may suitably include mechanical error detection means in the form of a book jam detector, a transfer book removal detector, a transfer housing-opened detector, all directly and operatively associated with the mechanical transfer 26 and its housing 26*a* (see FIG. 6*a*), and may also suitably include electronic error detection means in the electronic book tracking means or system 28 in the form of an electronic tracking overflow detector, an electronic tracking underflow detector, a missing book eye signal, and an inconsistent book eye signal (see FIG. 6*b*). In any such case, the error detection system 50 is operatively associated with the first and second binding line sections 12 and 14 so as to stop the respective continuous chain loops 16 and 22 thereof upon detecting one of the enumerated errors.

Figure 7:
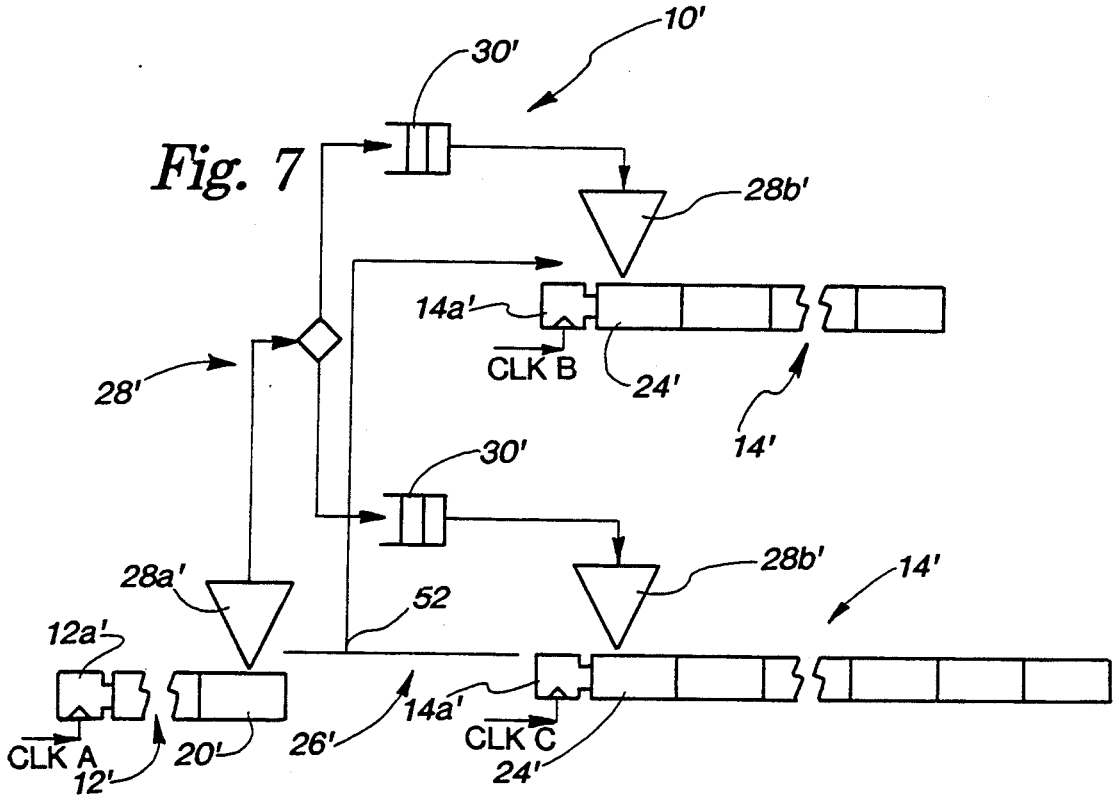
FIG. 7 is a model view or logical representation of book tracking for a multi-section binding line.

Referring now to FIG. 7, a multi-section binding line 10′ is illustrated. The binding line 10′ includes at least one first binding line section 12′ (a single section 12′ in the embodiment illustrated) and at least one second binding line section 14′ (a pair of binding line sections 14′ in the embodiment illustrated). As in FIGS. 1 and 2, a mechanical transfer 26′ will transfer and allocate books 18 from the book exit station 20′ of the first binding line section 12′ to the respective book entry stations 24′ of the pair of second binding line sections 14′. The mechanical transfer 26′ may comprise a multiple sectioned conveyor having a splitting device such as a diverter gate as at 52 to direct books to each of the pair of second binding line sections 14′. As will be appreciated, the mechanical transfer 26′ can be of any conventional type such as those previously mentioned.

Still referring to FIG. 7, the multi-section binding line 10′ will also include an electronic book tracking means or system generally designated 28′ for tracking books through time and space in the manner previously described hereinabove. The electronic book tracking means or system 28′ will again suitably include either photo book detector systems generally designated 61′ such as the cross-firing photoeyes 32 and light sources 34 at the book exit station 20′ and the respective book entry stations 24′, or correspondingly suitable intrinsic book identification means as described above in connection with FIG. 5. In the former case, a pair of internal FIFO buffers 30′ will be operative to track books from the first binding line section 12′, through the mechanical transfer 26′ including the diverter gate 52 and to the respective second binding line sections 14′.

Figure 8:
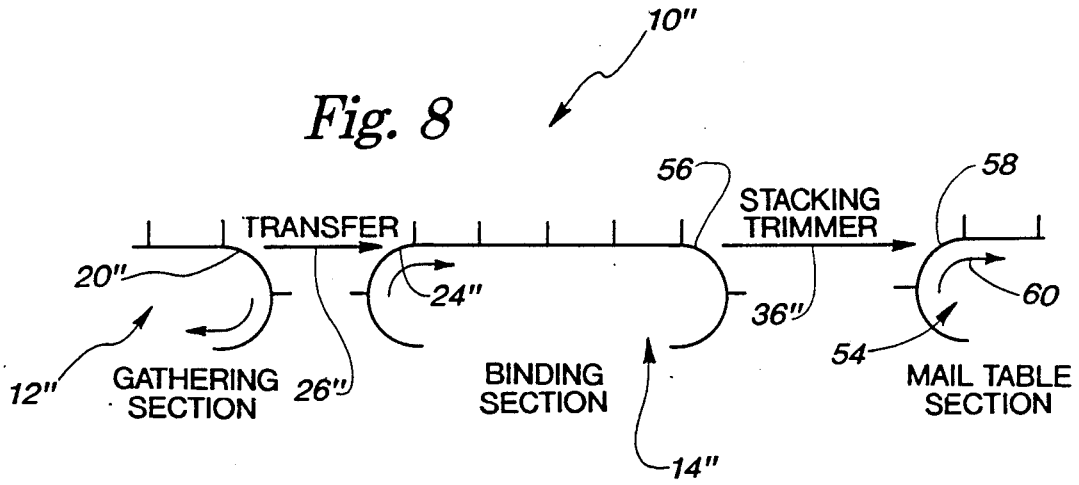
FIG. 8 is a mechanical schematic side elevational view of a binding line having three sections in series.
Figure 9:
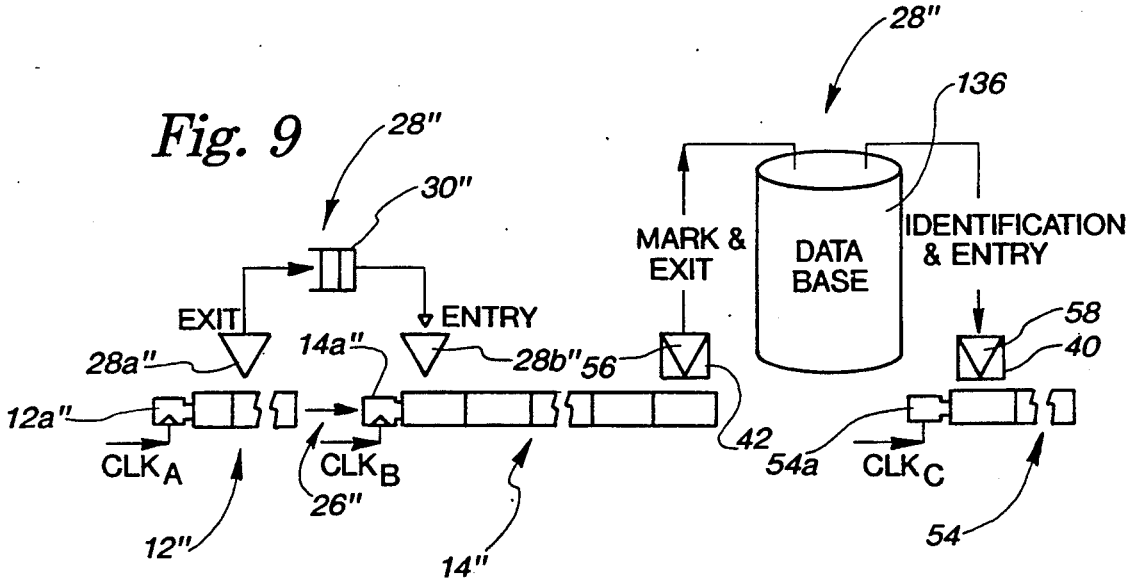
FIG. 9 is a model view or logical representation of book tracking for the binding line of FIG. 8.

Referring now to FIGS. 8 and 9, a multi-section binding line 10″ has been illustrated wherein the gathering section 12″ and binder section 14″ are again linked in series. The linking mechanism includes a mechanical transfer 26″ and an electronic book tracking means or system generally designated 28″, such as the photo book detector systems generally designated 61″ previously discussed, and in addition there has been added the third binding line section 54, i.e., the mail table section as discussed hereinabove, which is also linked to the binder section 14″ in series. In the illustrated embodiment, the stacking trimmer subsystem 36″ serves as the mechanical transfer for transferring books from the binder section 14″ to the mail table section 54.

More specifically, the binder section 14″ is operable so as to transport books therealong to the book exit station 56. The stacking trimmer subsystem 36″ (or any other suitable mechanical transfer mechanism or device) transfers books from the book exit station 56 of the binder section 14″ to the book entry station 58 of the mail table section 54 during which time a second electronic book tracking means or system also generally designated 28″, such as the bar code printer 42 and bar code scanner 40, intrinsically tracks books therethrough. As will be appreciated, the mail table section 54 will also include a continuous chain loop 60 for transporting books 18 therealong to a book exit station (not shown).

As should now be clear from the foregoing discussion, it is possible by utilizing the inherent characteristics of the binding line sections to devise a simple book tracking program. The order of books through the mechanical transfer 26 (or any other corresponding mechanical transfer) is strictly first-in, first-out (FIFO). Assuming that with the exception of known error conditions a book can never be lost while it is inside the mechanical transfer 26, the first book that comes through the transfer must be the first book that was sent into the transfer and, based on this assumption, a workable book tracking scheme can be implemented by utilizing only two sets of photoeyes 32. The photodetector system generally designated 61 in FIG. 3 utilizes the photoeyes 32 to monitor a book exit position such as 20 of the gathering chain 12 and a book entry position such as 24 of the binder chain 14. In this manner, the first book seen at the book entry position is the first book that passed through the book exit position.

Of course, it will be appreciated that the photoeyes 32 can only detect the presence of a book rather than its exact identity. The identity of the book must be indirectly established by presuming a FIFO book stream through the mechanical transfer 26. Accordingly, this method of book tracking is best described as a "blind date" program, i.e., first book received is first book sent.

In this model, each binding line section such as 12 and 14 is modeled as a shift register with its own clock which comprises a pulse encoder coupled to the respective drive shafts 12*a* and 14*a*. Data is passed from the upstream or gathering section 12 to the downstream or binder section 14 via an internal FIFO data store. As will be appreciated, the binding line sections, i.e., the gathering and binder sections 12 and 14, are free to run at the same or different speeds.

The basic assumption of this extended indirect book tracking method is that the mechanical transfer 26 can be modeled as a lossless FIFO so that a book detected at the book exit station 20 must be detected again at the book entry station 24. Any operation that can invalidate this assumption must be avoided or detected and, accordingly, it will be appreciated that a book jam at the mechanical transfer 26 may be the most common alarm condition. Under normal running and start/stop operations, the mechanical transfer 26 is a perfect book FIFO with the "blind date" program being unaffected by any blank chainspaces that may be created at the mechanical transfer 26.

Of course, a book that fails to trigger both photoeyes 32 at the book exit station 20 and/or the book entry station 24 will induce a systematic and cumulative error in book tracking. For this reason, redundant photoeyes 32 configured as a cross-firing pair (see FIG. 3) with complementary, i.e., high/low, outputs are used at both the book exit station 20 and the book entry station 24.

For periodically verifying the integrity of the book tracking operation, upstream production may be stopped and the line allowed to be purged. In a normal operation, the number of books detected at the book exit station 20 will be equal to the number of books detected at the book entry station 24. When it is required to resynchronize the "blind date" tracking process, the mechanical transfer 26 must be physically emptied of all books such that a new "first book" can be identified again at the book exit station 20. In this connection, all books inside the mechanical transfer 26 back to the book exit station 20 and forward to the book entry station 24 must be discarded when jammed books are in the mechanical transfer 26. Given the physical characteristics of the typical mechanical transfer 26, the number of books lost will typically be on the order of three to six.

The simplicity of the "blind date" tracking method is a direct result of the elimination of any requirement to track the actual "motion" of the mechanical transfer 26. For this reason, it can accurately be said that the tracking method of the invention is operatively independent of the operational characteristics of the mechanical transfer 26.

Figure 10:
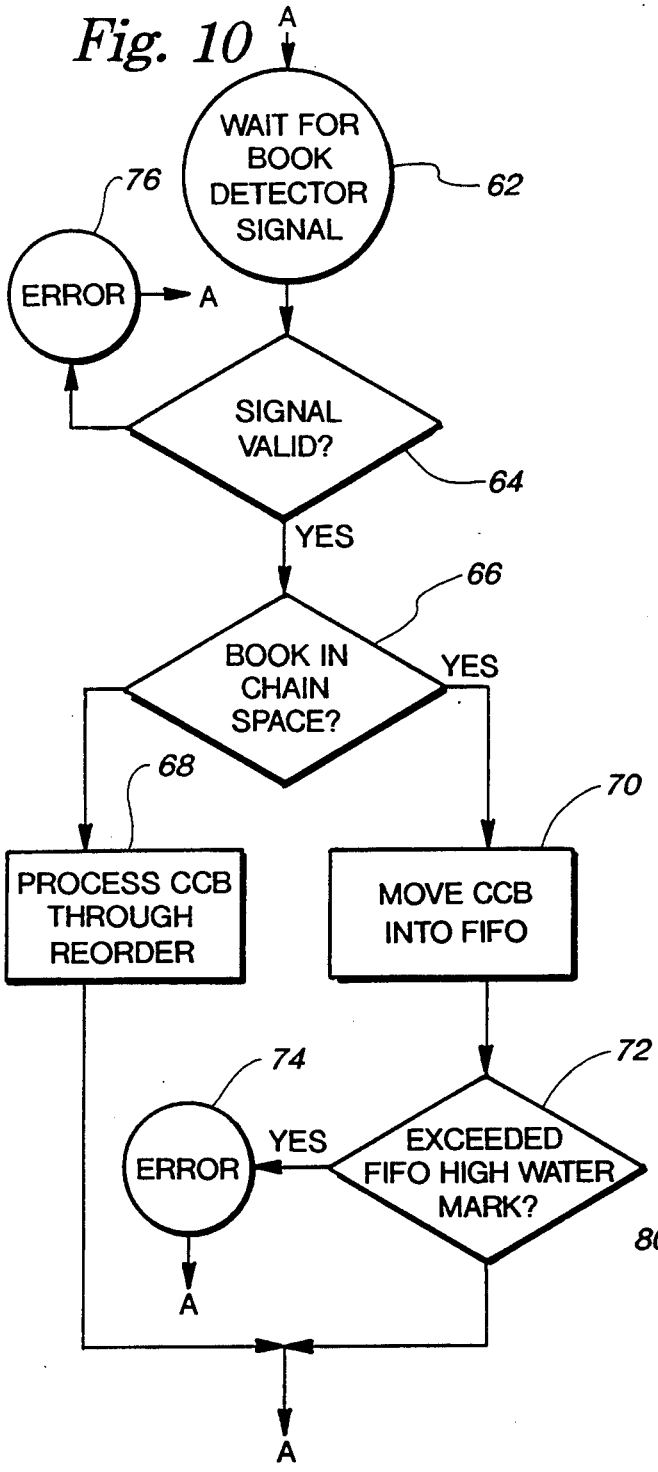
FIG. 10 is a logic diagram for tasks at or upstream of an exit point of an upstream section of the binding line of FIG. 1.

Referring to FIG. 10, a flow chart of the program that operates at the book exit point 20 of the first binding line section 12 is illustrated. Control begins at block 62 where a book detector signal is awaited. This book detector signal is actually a pair of signals; one of the signals being a gated signal which has a high output when a book is between the cross-firing pair of redundant photoeyes 32 and the other of the signals being a gated signal which has a low output when this occurs. Control passes to decision block 64 which determines whether a valid photoeye signal has been received. If the signal is valid, control passes to decision block 66 where a determination is made as to whether a book is in the chainspace.

If decision block 66 determines that there is no book in the chainspace, control passes to block 68 where the chainspace control block (CCB) is processed through reorder. The chainspace control block (CCB) contains control information about the book that should have been in that chainspace. Since the chainspace is empty, the book may, by way of example, have been previously rejected, manually removed, or otherwise not made up, etc.

Before continuing, each chainspace on a binding line section is represented by a data structure, i.e., the chainspace control block (CCB). In addition to data that defines the state of the chainspace, the chainspace control block (CCB) holds all the information needed to define the interaction of a device and the chainspace that is currently under that device. A device either takes action based upon data in the chainspace control block (CCB) or updates the data in the chainspace control block (CCB).

Taking action based upon data in the chainspace control block (CCB) includes, for example, rejecting the content of a chainspace that is marked as bad, transferring label data from the chainspace control block (CCB) to a ink jet station, etc. Updating the data in the chainspace control block (CCB) includes, for example, the caliper marking the chainspace control block (CCB) to indicate the book in the chainspace is out of spec.

Referring again to decision block 66, control will pass to block 70 in the event there is a book in the chainspace. At block 70, the chainspace control block (CCB) is moved into the internal FIFO 30 and control is passed to decision block 72. At decision block 72, it is determined whether the FIFO high water mark has been exceeded, i.e., whether a FIFO electronic overflow condition exists.

In this connection, the high water mark is established as the maximum number of books that can be in the electronic book tracking means or system 28, 28' etc. If the FIFO high water mark is exceeded, there are more books logically in the internal FIFO 30 than can physically be present in the book transfer 26. When this occurs, an error condition exists which transfers control to block 74.

Referring again to decision block 64, an error condition exists which will transfer control to block 76 when there is an invalid signal. An invalid signal may occur, for instance, in the case of a missing or inconsistent book eye signal or the like (see FIG. 6*b*). Usually that would occur if one of the cross-firing pair of redundant photoeyes 32 is blocked or improperly aimed.

Figure 10A:
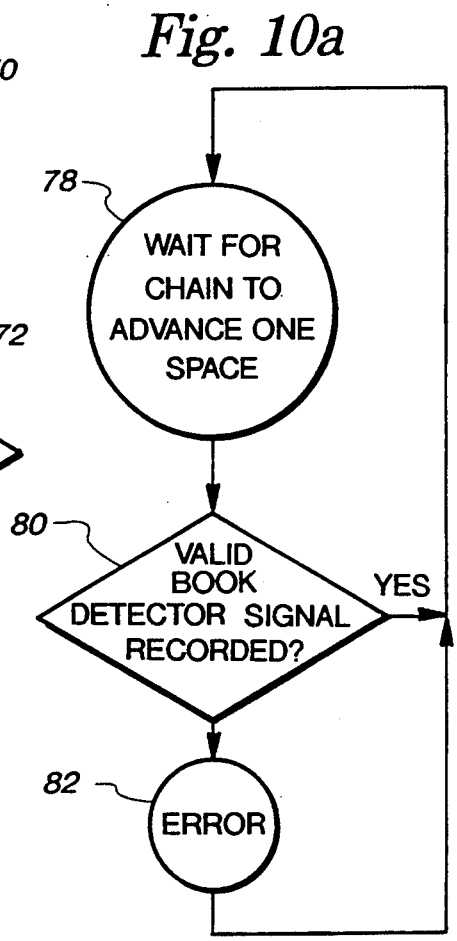
FIG. 10*a* is a logic diagram of a concurrent operation at or upstream of the exit point of the upstream section of the binding line of FIG. 1.

In parallel with the program illustrated in FIG. 10, FIG. 10*a* also illustrates a flow chart of a program that operates concurrently at the book exit station 20 of the first binding line section 12. This program awaits advancement of the chain by one space at block 78 and, once this occurs, control passes to decision block 80 where a determination is made whether a valid book detector signal is recorded. If not, control passes to block 82 which indicates an error condition, i.e., a missing book eye signal, and, whether or not a valid book detector signal is recorded, control returns to block 78 for the next cycle of movement of the chain.

Referring to FIGS. 10 and 10*a*, they essentially represent parallel, i.e., concurrent, but independent processes. FIG. 10*a* represents the process by which it is determined whether the chainspace phase signal produced for every chainspace has occurred; if not, block 82 indicates that an error exists, i.e., the book exit signal is missing. On the other hand, FIG. 10 represents a process that occurs only when a book detector signal is received at block 62.

In other words, FIG. 10*a* has reference to time cycles, e.g., one cycle for every time the line advances by a chainspace. Thus, it is possible to know when a new chainspace or a new cycle has been reached. In contrast, FIG. 10 has reference simply to whether a book detector signal has been received.

With this understanding, FIG. 10 awaits and processes book detector signals whereas FIG. 10*a* awaits and processes chainspace phase signals. Thus, for every given cycle of FIG. 10*a*, there should be one and only one book detector signal from FIG. 10 in the proper phase. As will be appreciated, this serves as a check to make sure that book detector signals are only arriving once in each chain cycle during the proper phase.

Referring to FIGS. 11 and 11*a*, they are very similar to FIGS. 10 and 10*a* described in detail hereinabove. In fact, FIG. 11*a* operates essentially in exactly the same manner as FIG. 10*a* with the exception that it looks for a chainspace phase signal at the book entry station 24 of the second binding line section 14 rather than the chainspace phase signal at the book exit station 20 of the first binding line section 12. However, with regard to FIG. 11, there is one additional decision block to be considered.

Referring to FIG. 11, control begins at block 62' where a book detector signal is awaited at the book entry station 24 of the second binding line section 14. Once a signal is received, control passes to decision block 64' which determines whether a valid signal has been received in which case control passes to block 84 which determines whether an error flag has been raised. If a valid signal has not been received at decision block 64', control passes to block 76' which indicates that an error condition exists.

If a determination is made at decision block 84 that an error flag has been raised, an error condition exists and error recovery is required.

Figure 12:
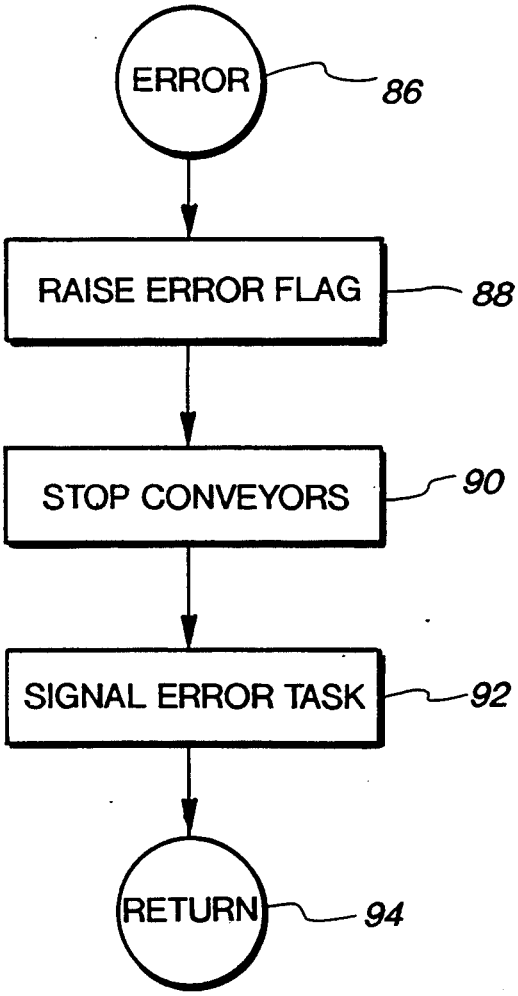
FIG. 12 is a logic diagram of an error signaling procedure.

As will be seen from FIG. 12, if an error condition exists anywhere in the system as represented by block 6, control passes to block 88. There, an error flag is raised and control passes to block 90 where the binding line lo is stopped following which control passes to block 92 where an error task is signalled. From there, control passes to block 94 which causes a return to the calling location.

It will be seen that when an error flag is raised, control block 96, which awaits notification of such an error condition, will be signalled from block 92 (see FIG. 12). From block 96, control passes to block 98 where the book path between photo book detector systems generally designated 61 at opposite ends of the mechanical book transfer 26 are cleared (a manual operation).

Control then passes to block 100 which allows for restarting of the downstream portion of the binding line, i.e., the second binding line section 14. At this point no book detector signals or gate signals are being received at the book exit station 20 of the first binding line section 12, i.e., block 62 in FIG. 10 and block 78 in FIG. 10*a*, but book detector signals and gate signals are being received at the book entry station 24 of the second binding line section 14, i.e., block 62' in FIG. 11 and block 78' in FIG. 11*a*. In other words, while there are no books physically in the book transfer 26, there may well be books logically in the internal FIFO 30.

If so, control passes from block 100 to block 102 to wait for the error flag to clear which occurs as illustrated in FIG. 11 wherein decision block 95 determines whether there is any chainspace control block (CCB) in the internal FIFO 30 in which case control passes to block 106. If so, the chainspace control block (CCB) is reordered, dumped onto a chainspace and marked as "unknown" or "UFO" after which the book entry station 24 of the second binding line section 14 again waits for a book detector signal as at block 62' in FIG. 11.

If there is no chainspace control block (CCB) in the internal FIFO 30 as determined at block 95, control passes to block 108 where the error flag is cleared after which the book entry station 24 of the second binding line section 14 again waits for a book detector signal as at block 62' in FIG. 11.

Figure 13:
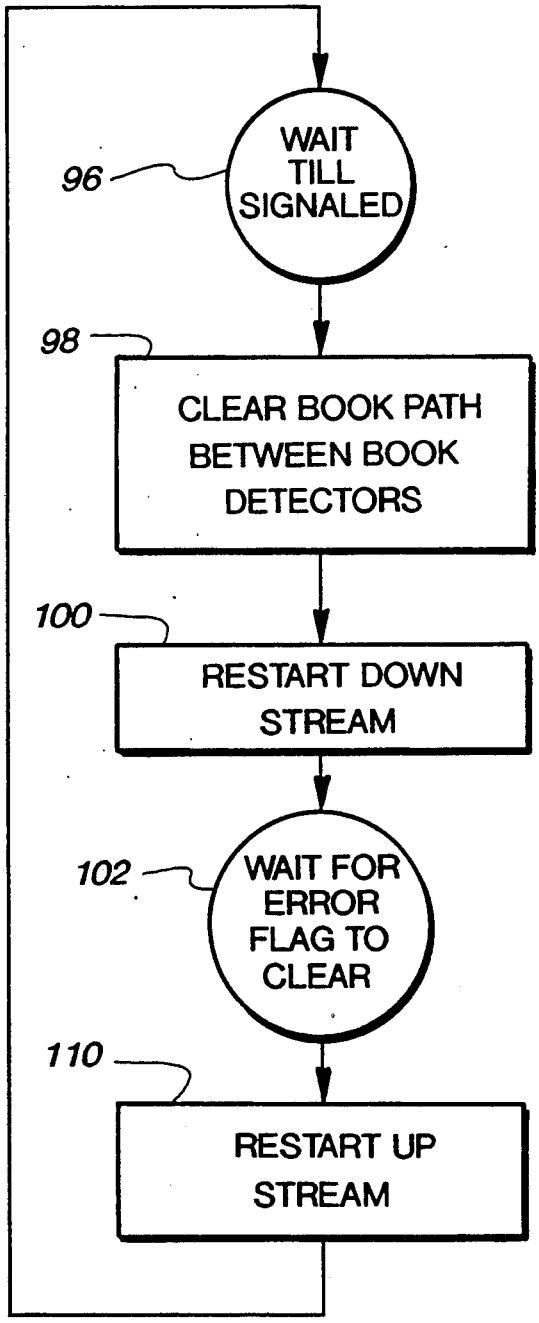
FIG. 13 is a logic diagram of an error recovery task.

Once the error flag is cleared, control passes from block 102 in FIG. 13 to block 110 to allow for the restarting of the upstream section of the binding line 10, i.e., the first binding line section 12.

As will be appreciated, the internal FIFO 30 is empty once this condition has been achieved. It will also be appreciated that the mechanical book transfer 26 is physically empty of books when the first binding line section 12 is restarted. As a result, the electronic book tracking of the internal FIFO 30 can again be restarted.

Figure 6A:
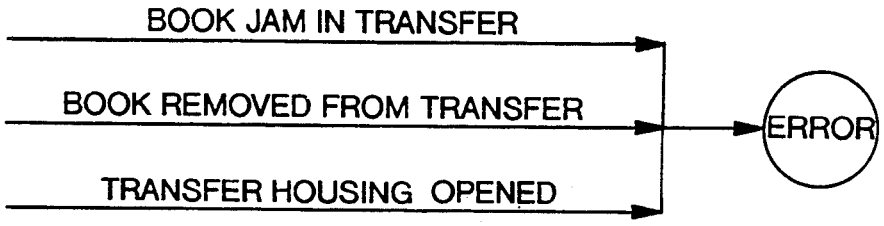
FIG. 6*a* is a logic diagram of mechanical error signals.
Figure 6B:
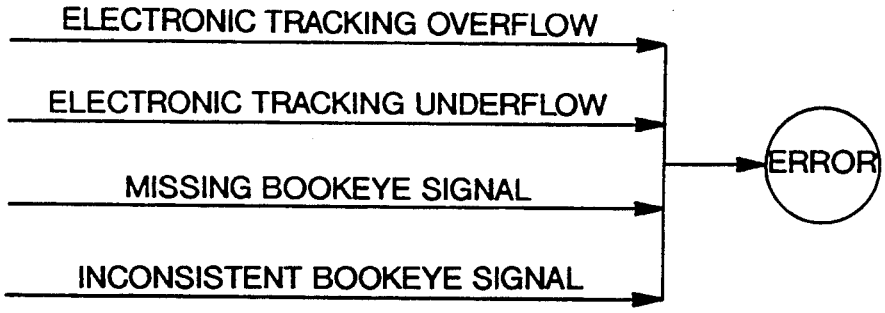
FIG. 6*b* is a logic diagram of electronic error signals.

Referring to FIGS. 6*a* and 6*b*, the various occurrences that can trigger an error condition are set forth. For instance, in FIG. 6*a* are set forth the various mechanical error conditions including book jam in the book transfer 26, a book removed from the book transfer 26, or the unauthorized opening of the book transfer housing 26*a*. In like fashion, FIG. 6*b* illustrates an electronic tracking overflow condition, an electronic tracking underflow condition, a missing book eye signal, and an inconsistent book eye signal.

As for the electronic tracking overflow condition in FIG. 6*b*, this is the error condition signalled at block 74 in FIG. 10. The electronic tracking underflow condition is the error condition signalled at block 112 in FIG. 11. The missing book eye signal is the error condition signalled at blocks 82 and 82′ in FIGS. 10*a* and 11*a*. As for the inconsistent book eye signal condition in FIG. 6*b*, this is the error condition signalled at blocks 76 and 76′ in FIGS. 10 and 11.

For all of the aforementioned error conditions of FIGS. 6*a* and 6*b*, control is transferred to block 86 in FIG. 12.

Referring once again to FIG. 11, if no error flag is raised at block 84, control passes to decision block 66′ to determine whether there is a book in the chainspace. Control passes to block 68′ if a determination is made that there is no book in the chainspace where an empty chainspace control block (CCB) is assigned to the chainspace. However, control passes to decision block 70′ should there be a book in the chainspace to determine whether there is a chainspace control block (CCB) in the internal FIFO 30. If so, control passes to block 72′ where the chainspace control block (CCB) is moved from the internal FIFO 30 to the chainspace.

If there is no chainspace control block (CCB) in the internal FIFO 30 at block 70′, an error condition is signalled and control passes to block 112 as previously noted.

In parallel with the program of FIG. 11, FIG. 11*a* also illustrates a flow chart of a program that operates concurrently at the book entry station 24 of the second binding line section 14. It awaits advancement of the chain by one space at block 78′ and, once this occurs, control passes to decision block 80′ where a determination is made whether a valid book detector signal is recorded. If not, control passes to block 82′ which indicates an error condition and, whether or not a valid book detector signal is recorded, control returns to block 78′ for the next cycle of movement of the chain.

As with FIGS. 10 and 10*a*, FIGS. 11 and 11*a* essentially represent parallel, i.e., concurrent, but independent processes. FIG. 11*a* represents the process by which it is determined whether the chainspace phase signal produced for every chainspace has occurred; if not, block 82′ indicates that an error exists, i.e., the book entry signal is missing. On the other hand, FIG. 11 represents a process that occurs only when a look detector signal is received at block 62′.

In other words, FIG. 11*a* has reference to time cycles, e.g., one cycle for every time the line advances by a chainspace. Thus, it is possible to know when a new chainspace or a new cycle has been reached. In contrast, FIG. 11 has reference simply to whether a book detector signal has been received.

With this understanding, FIG. 11 awaits and processes book detector signals whereas FIG. 11*a* awaits and processes chain phase signals. Thus, for every given cycle of FIG. 11*a*, there should be one and only one book detector signal from FIG. 11. As will be appreciated, this serves as a check to make sure that book detector signals are only arriving once in each chain cycle.

As for the binding line 10″ illustrated in FIG. 8, a perfect binding line is typically separated into three sections such as 12″, 14″ and 54. A mechanical transfer or conveyor 26″ typically separates but links the binder section 14″ and the gathering section 12″ whereas a stacking trimmer subsystem 36 separates but links the mail table section 54 and the binder section 14″. For speed and trim quality, the type of book trimmer that is typically used on a perfect binding line is a multi-book trimmer 46 (see FIG. 5).

Given the design of the stacking trimmer subsystem 36, its operation is inherently asynchronous to the binder section 14″ and decoupled operation allows the stacking trimmer subsystem 36 to continue operation even when the binder section 14″ is stopped. In this connection, it is also a general practice to allow books from the binder section 14″ to be piled off while the stacking trimmer subsystem 36 is shut down but tracking piled-off books has been known to be a significant problem in the art.

The key components of the stacking trimmer subsystem 36 are illustrated in FIGS. 4 and 5. Books 18 from the binder section 14″ are piled into the stacking book box 44 a smaller stack grouped either by total thickness or book count is removed from the bottom of the stack by either a stack pushing mechanism 114 or a chain pin 116, and the smaller book stack is carried on the trimmer table 118, through the trimmer blades 120 at the multi-book trimmer station 46 then up an incline or trimmer out-feed conveyor 122 where the stack is fed into the unstacking book box 48. From there, books 18 are removed from the unstacking book box 48 by either a single book pushing mechanism 124 or a chain pin 126 onto the mail table section 54.

Since the flow path of books through the stacking trimmer subsystem 36 cannot be characterized in simple terms, the task of tracking how a book is transported from one location to the next becomes exceedingly difficult. However, by providing individual book identifying information directly on the books, i.e., intrinsic identification such as a bar code 38, the need to track the flow path of the books through the stacking trimmer subsystem 36 is entirely eliminated. At any location when processing on the book is required, information carried on the book itself can be used to reidentify and, thus, track the book after the processing has been completed. Ideally, by providing individual book identifying information directly on the books, books that enter the mail table section 54 from the stacking trimmer subsystem 36 can be reidentified by their intrinsic identification code. Since the ability to track individual books has been established, it is now possible to overcome the difficulty of attempting to model the motion characteristics of the stacking trimmer subsystem 36 which can now be treated simply as a transfer buffer.

The programming model for the book path through the stacking trimmer subsystem 36 is simply a data store with a capacity equal to the holding capacity of the trimmer section 141. A book exiting the binder section 14″ is tagged with an identification code, i.e., bar code 38, and the control information of this book is stored. When a book enters the mail table section 54, it is reidentified by its identification code and matched back to the stored information.

As shown in FIGS. 8 and 9, each of the three sections of the binding line 10'', i.e., the gathering section 12'', the binder section 14'' and the mail table section 54, is modeled by a shift register with its own clock which comprises a pulse encoder coupled to the respective drive shafts **12*a*'', 14*a*'' and 54*a*. The mechanical book transfer 26 between the gathering section 12'' and the binder section 14'' is electronically tracked by an internal FIFO data store or buffer 30'' and the stacking trimmer subsystem 36 which serves as the book transfer between the binder section 14'' and the mail table section 54 is electronically tracked by a keyed database 136 where the identification code of a book is used as the key (see FIG. 5). In summary, the binding line 10'' is modeled as three asynchronous sections, i.e., the gathering section 12'', the binder section 14'' and the mail table section 54**, bridged in series by transfer buffers.

As for indirect tracking, i.e., FIFO, the reliability of the tracking method depends o the inherent characteristics of the book flow path. In the case of a continuous slotted chain, the possibility of mistracking (slipped chain) is very low whereas in the case of a mechanical transfer such as a conveyor, tracking reliability depends on both the accuracy of the photo book detector systems generally designated 61 and the proper setup of initial conditions, i.e., the first book detected at the binder section 14 must be the first book out of the gathering section 12 (see FIGS. 1 and 2). In the case of the stacking trimmer subsystem 36, which has a complex flow path due to book stacking and unstacking, the possibility of error would be very high.

In contrast, direct book identification reliability depends only on the successful identification of the printed code. It will, thus, be seen in FIG. 5 that a plurality of bar code scanners 40 may suitably be provided in order to very nearly ensure identification by reason of the redundant scanners. In any event, since each book has a unique identification code, error in the identification of a book will not induce any systematic or cumulative tracking error.

As for direct book tracking as illustrated in FIG. 5, a line controller 130 is linked to the bar code printer 42 and to one or more of the bar code scanners 40. This is typically accomplished by means of data communication lines 132 and 134, respectively, but whatever the linking means, the line controller 130 executes programs for the electronic book tracking means or system and houses a book tracking database 136 for which the programs control the storage and retrieval of information. Further, the programs also control data communication with both the bar code printer 42 and the one or more bar code scanners 40.

Data communication line 132 which links the line controller 130 and the bar code printer 42 carries bidirectional data flow and the line controller 130 transmits the data of the information to be printed to the bar code printer 42. In reply, the bar code printer 42 transmits the data of the result of each print command back to the line controller 130. If the reply indicates a successfully printed bar code 38, the program in the line controller 130 will store the book identification of the book which was printed with the bar code 38 into the book tracking database 136.

Data communication lines 134 which link the line controller 136 and the bar code scanner or scanners 40 carries unidirectional data flow from the bar code scanner or scanners 40 which transmit the data of the bar codes 38 which are read to the line controller 130. If more than one bar code scanner 40 is incorporated in the physical subsystem, a separate data communication line 134 is required to connect each bar code scanner 40 with the line controller 130. With this arrangement, the data of the bar codes 38 is used by the program in the line controller 130 to attempt to retrieve the book identification from the book tracking database 136 for the book which contained the bar code.

The stacking book box 44, the multi-book trimmer 46 and the unstacking book box 48 are three devices which do not allow for the direct association of one unique book to a particular chainspace. Therefore, the physical subsystem is configured with the bar code printer 42 located before these devices and one or more bar code scanners 40 located after these devices.

Non-bar coded books as at 138 are contained in the chainspaces along the bar code printer section of the binder section 14'' and are identified by the particular chainspaces in which they are contained. When the non-bar coded books as at 138 pass under the bar code printer 42 they are printed with a particular bar code 38 as determined under the direction of the program which is executing in the line controller 130. As each book is printed with a bar code 38, the program stores the book identification in the book tracking database 136 housed in the line controller 130.

Referring to FIGS. 4, 5 and 8, the bar coded books as at 140 continue to travel along the bar code printer portion of the binder section 14'' to the stacking book box 44 where a stack of books is formed. When a preset height of books is obtained within the stacking book box 44, the stack pushing mechanism 114 or chain pin 116 moves the stack of books from the stacking book box 44 to the first available chainspace on the trimmer table 118 in the multi-book trimmer section 141 of the binding line 10''. The chainspaces along the trimmer table 118 of the binding line 10'' employ chain pins such as 116 of a sufficient height, to allow pushing along the entire height of the books which are ejected from the stacking book box 44. Then, the stack of books is transported to the multi-book trimmer 46 by the chain pins 116 on the trimmer table 118 of the binding line 10'' wherein the entire stack of books is trimmed concurrently.

The stack of trimmed books is next carried along the trimmer table 118 to the unstacking book box 48 where the books fall onto a stack of whatever books may remain from the previous stack of books. Referring to FIGS. 4 and 5, the unstacking book box 48 employs either a separate single-book pushing mechanism 124 which pushes only the bottom book in the stack onto a chainspace or a chain pin 126 of the mail table section 54.

Because each book is confined to a single chainspace along the mail table section 54 of the binding line 10'', the traditional method of tracking books, with the book identification associated with a particular chainspace, may be utilized so long as there is a means to determine the book identification to be associated with each chainspace.

For this purpose, the bar code scanner or scanners 40 attempt to read the bar codes 38 of the books 18 for the purpose of transmitting this data to the line controller 130 where the data of the bar codes 38 is there used by the program in the line controller 130. More specifically, the data is used to attempt to retrieve the book identification from the book tracking database 136, i.e., to associate the bar code read with a book which was imprinted with that particular bar code; a successfully retrieved book identification will then be stored for the chainspace which contained that particular book which will allow for a direct association of one unique book for an particular chainspace. Upon having a valid book identification stored for a chainspace, the program will not process the data received from any subsequent bar code scanners 40 to attempt to retrieve the book identification for the book contained on that chainspace.

However, if the identification of the book was not successfully retrieved from the book tracking database 136, the book identification will remain as "unknown" for that particular chainspace and the data received from any subsequent bar code scanners 40 for the book on that chainspace will also be processed by the program in an attempt to retrieve the identification of that book from the book tracking database 136.

The bar code numbering sequence scheme to be implemented will vary depending on a number of different factors. These include the maximum number of books which may be contained within the stacking trimmer, or other physical, subsystem at any given time, the number of unique locations within the book tracking database, and the extent of error checking desired. The bar code numbering sequence should provide a uniform, cyclic access key to all locations in the book tracking database.

With this understanding, the maximum number of books which may be contained within the physical subsystem at any given time determines the minimum number of unique locations which must be available within the book tracking database. The maximum number of unique locations within the book tracking database may be any practical amount but is limited by the amount of available memory. For explanatory purposes it can be considered that a limit of one hundred books may be contained within the physical subsystem at any given time which would mean that a minimum of one hundred unique locations must be available within the book tracking data base.

If this should be the case, the bar code numbering sequence to be used must provide at least one hundred unique numbers to access at least one hundred unique locations in the book tracking database in which case the memory limitation of the system might actually allow for no more than one hundred fifty unique locations within the book tracking database. Based on these constraints, a three digit numeric value could be selected wherein the numerics zero through nine are valid in the first digit, the numerics zero through seven are valid for both the second and third digit, and the numeric in the third digit is incremented after each successive book is printed with a bar code. When the third digit is incremented from seven, that digit is reset to zero, and the second digit is incremented; likewise, when the second digit is incremented from seven, that digit is reset to zero, and the first digit is incremented; and when the first digit is incremented from nine, that digit is reset to zero.

With this numbering scheme, six hundred forty unique numbers are available. By dividing the six hundred forty numbers into five groups of one hundred twenty-eight unique numbers each, an error check digit is established for each quantity of unique numbers, i.e., each group of one hundred twenty-eight unique numbers, which corresponds to an acceptable size for the book tracking database. The first digit is used to provide the means for grouping the numbers in this manner.

More specifically, this is accomplished by using the even or odd characteristics of the first digit such that, when the first digit is even, the first group of sixty-four locations is accessed in the book tracking database. Likewise, when the first digit is odd, the second group of sixty-four locations is accessed. Since there are five even and five odd possibilities for the first digit, there are five numbers in the bar code numbering sequence which may access each of the one hundred twenty-eight unique locations in the book tracking database.

An error check digit is required to determine which of the five groups of numbers was used to store the book identification at each location in the book tracking database. The error check digit is established from the remainder of the first digit, and is stored at each location in the book tracking database, along with the book identification.

Referring to FIGS. 14*a–f*, six separate basic examples of book sequence input/output scenarios are illustrated. These scenarios graphically depict the various situations which may occur as books are processed by, e.g., a physical subsystem having one or more devices which prohibit book tracking via chainspace association such as a stacking trimmer subsystem, thus demonstrating the need for an electronic book tracking system. An exhaustive set of examples may be generated by applying combinations and multiples of these basic examples.

In each of the diagrams in FIGS. 14*a–f*, the direction of binding line movement is from the left to the right. For simplicity of the diagrams, the devices which prohibit book tracking via chainspace association have been grouped into a single, non-specific block. Further, the bar code printer and the bar code scanner or scanners in each example have been omitted from the diagrams.

However, if the devices were shown in the diagrams in FIGS. 14*a–f*, they would be positioned similar to that shown in FIG. 5. The books shown to the left side of the devices which prohibit book tracking via chainspace association represent a sequence of bar coded books prior to being processed by these devices with the books shown on the right side of these devices representing a sequence of bar coded books which may appear after being processed by these devices. As will be appreciated, the books shown on the right side of these devices will normally be the sam books from the left side but at a later point in time.

Figure 14A:
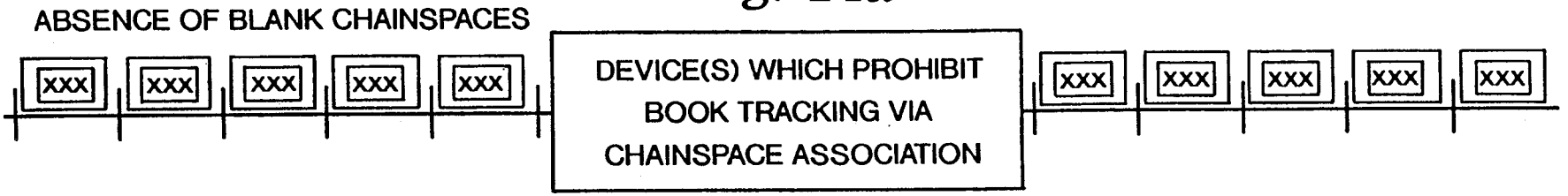
FIGS. 14*a*–14*f* are schematic illustrations of book sequence input/output scenarios.

Referring specifically to FIG. 14*a*, the scenario depicted is identical to that shown in FIG. 5. Thus, without regard for the bar code numbering sequence marked on the books, all chainspaces leading into the devices and all chainspaces leading out of the devices are filled with a unique book. Further, and again without regard for the bar code numbering sequence marked on the books, the books may be considered as being marked "XXX" in place of the bar code sequence number. This is the typical scenario when the binding line is operating properly with respect to the speed of the different sections thereof.

Figure 14B:
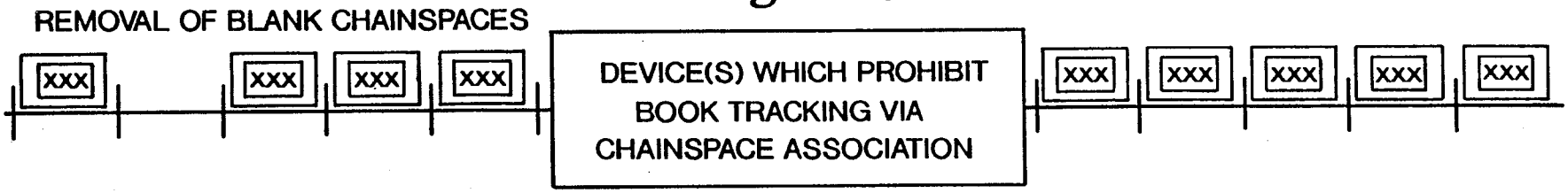

Referring to FIG. 14*b*, there is a blank chainspace leading into the physical subsystem which includes devices that prohibit book tracking via chainspace association although all of the chainspaces leading out of the devices are filled with a unique book. The blank chainspace leading into the physical subsystem may be due to an earlier rejected book. For example, if the caliper measurement was not as expected for the book, it will be reordered and flagged to be rejected at the next reject gate. The result of this will be the generation of a blank chainspace. Since the books are not necessarily confined to an individual chainspace while within the physical subsystem due to the devices that prohibit book tracking via chainspace association, any buffering of books within the physical subsystem may allow for the blank chainspace to be removed from the chainspaces leading out of these devices.

Figure 14C:
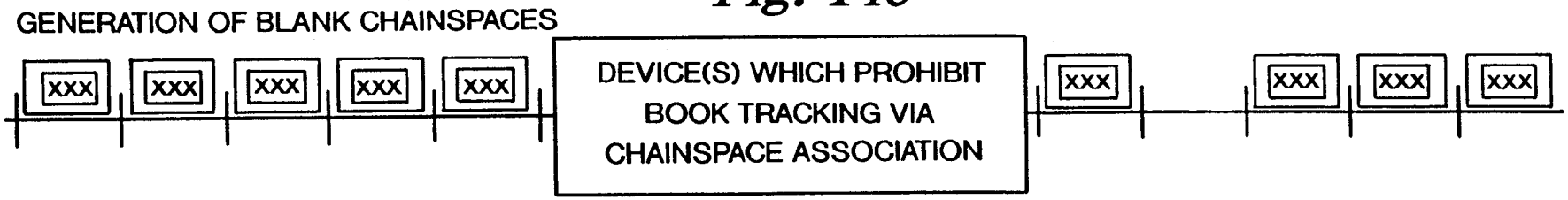

Referring to FIG. 14*c*, all of the chainspaces leading into the devices which prohibit book tracking via chainspace association are filled with a unique book. However, there is a blank chainspace leading out of the devices. In this connection, the blank chainspace may be due to either a lack of buffered books within the devices or a stoppage of the section of the binding line containing the devices.

Figure 14D:
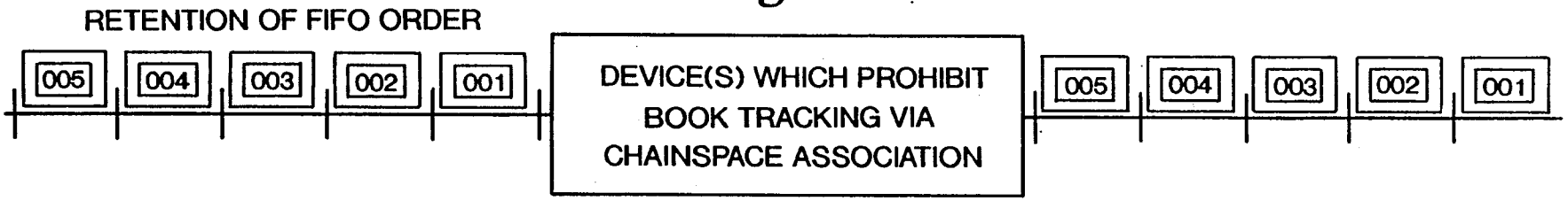
Figure 14E:
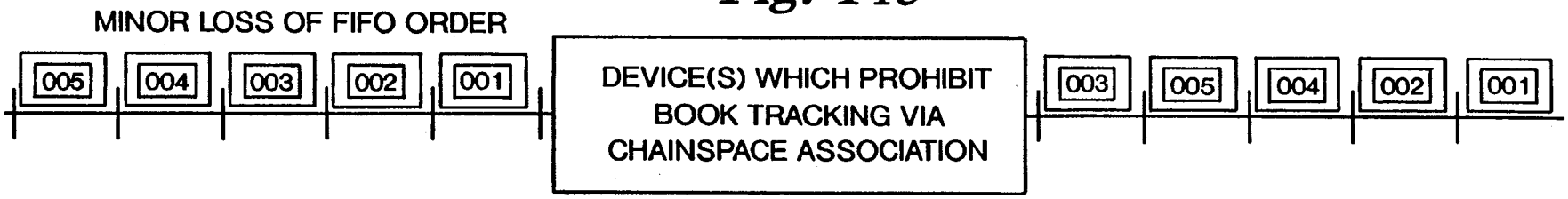
Figure 14F:
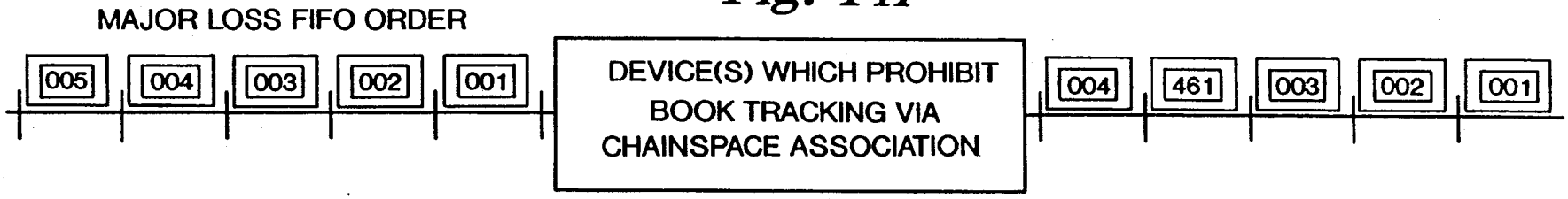

Referring to FIGS. 14*d–f*, the FIFO ordering of books is illustrated. In FIG. 14*d*, the FIFO ordering of books is retained after the books have been processed by the devices which prohibit book tracking via chainspace association. This is depicted by the identical sequence of bar code numbers on the books which are on the chainspaces leading out of these devices as on the chainspaces leading into these devices. In FIG. 14*e*, it will be noted that a minor loss of the FIFO ordering of books has been illustrated. For instance, this may occur as the books are processed by the devices which prohibit book tracking via chainspace association.

In FIG. 14*e*, the book with the identification "003" has been displaced after the books with the identification "004" and "005" on the chainspaces leading out of the devices. Due to the proximity of the sequence number of the displaced book, the electronic book tracking system will be able to recover from this minor loss of FIFO ordering. Moreover, this can occur without the need to reorder or reject any books since the book identification will still be present in the book tracking database.

Referring now to FIG. 14*f*, it will be appreciated that a major loss of FIFO ordering of books has been illustrated. In this example, the book with the identification "461" appears in a series of books which contain sequence numbers which are not part of the same locale in the bar code numbering sequence. In this connection, the book may be rejected by the electronic book tracking system since the book identification for the book containing the number "461" may have been overwritten in the book tracking database. Moreover, the electronic book tracking system will have reordered this book at the time at which the book identification was overwritten in the book tracking database.

Figure 15B:
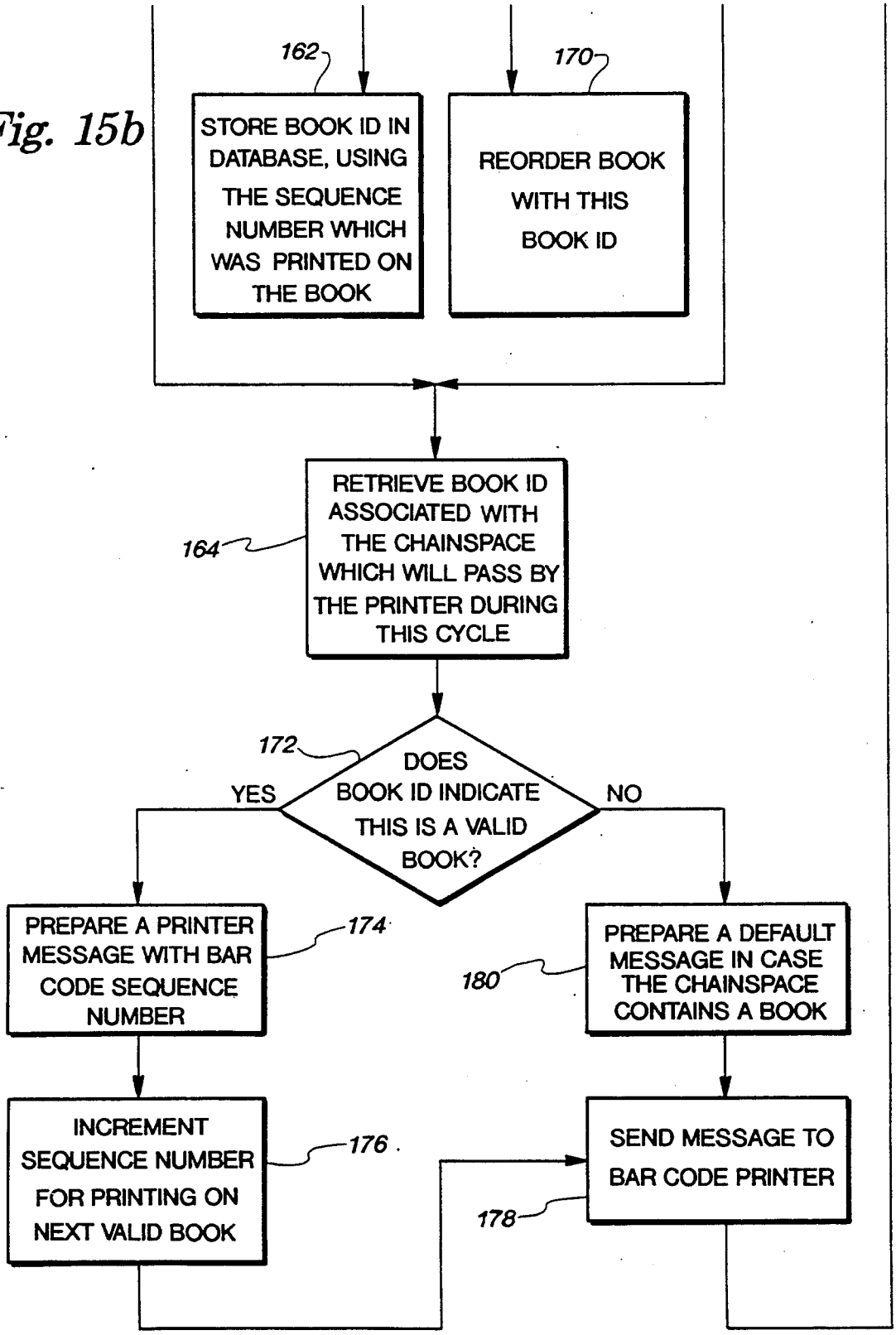

Referring to FIG. 15, a flow chart of the program which controls communication with the bar code printer and performs the associated database operations is illustrated. Control begins at block 150 where the bar code sequence number is initialized and the book tracking database is cleared. Next, control passes to decision block 152 where a check is made to determine if the binding line is at the beginning of a cycle.

If the binding line is not at the beginning of a cycle, control passes back to decision block 152. In this manner, the program is caused to wait for the beginning of a cycle. If the binding line is at the beginning of a cycle, decision block 152 passes control to block 154.

At block 154, the printer response from the previous cycle is analyzed to determine whether the print command was successfully executed. Either it was successfully executed or a problem occurred, such as the lack of a photoeye triggering, which caused the printer to have failed to execute the print command. Next, control passes to decision block 156 which will alter the program flow based upon the analysis of the printer response.

If the previous print command was successfully executed, control passes to block 158 where the book identification associated with the previous chainspace, i.e., the chainspace that contains the book which has just been successfully printed with a bar code, is retrieved by traditional means since the book identification is still directly associated to that chainspace. Control then passes to decision block 160 where this book identification is checked to determine if it is for a valid book. Book identifications which might indicate invalid books are, for example, where the book identification indicates that the chainspace was supposed to be blank or that the chainspace contains a book which has already been marked for rejection and reordering. If the check reveals that the book identification is for a valid book, control passes to block 162 where the book identification is then stored in the book tracking database using the bar code sequence number which was printed on the book as a key to determine the storage location in the book tracking database.

If there is already a book identification stored at this particular database location, it is due to the fact that it has not been cleared out which should otherwise have occurred if the book had successfully exited the physical subsystem. When this occurs, the book associated with the existing book identification is reordered to ensure that this book will be produced and, after reorder, the book identification will be overwritten in the database with the book identification for the book newly entering the database system. If decision block 160 determines that the book identification indicates that an invalid book was successfully printed with the bar code, control will pass to block 164.

Similarly, after the storage of a valid book identification into the database at block 162, control will pass to block 164.

Returning to decision block 156, if the previous print command was not successfully executed, control will pass to block 166. At block 166, the book identification associated with the previous chainspace, which is the chainspace that contains the book which has not just been successfully printed with a bar code, is retrieved by traditional means since the book identification is still directly associated to a chainspace. Next, control passes to decision block 168 where this book identification is checked to determine if it is for a valid book.

As before, examples of book identifications which indicate invalid books are when the book identification indicates that the chainspace was supposed to be blank, or that the chainspace contains a book which has already been marked for rejection and reordering.

If the book identification is for a valid book, control passes to block 170 where the book with the known book identification is reordered since it has not been marked with a bar code and thus will not be able to be identified at the bar code scanner. Control then passes to block 164 just as will occur if the book identification does not indicate that the chainspace contains a valid book at decision block 168. At block 164, the book identification associated with the chainspace which is about to pass under the bar code printer is retrieved in traditional manner since the book identification is directly associated with a given chainspace.

From block 164, control passes to decision block 172 where the book identification is checked to determine if it is for a valid book. If the book identification is for a valid book, then the book should be marked with a bar code and enter the electronic book tracking system such that control passes to block 174. At block 174, a printer message is prepared which contains the bar code sequence number which is to be printed on the book.

Next, control passes to block 176 where the bar code sequence number is incremented for the next occurrence of a valid book to receive a bar code. From there, control passes to block 178 where a message which contains the bar code sequence number is sent to the bar code printer. There, the message will be printed when the printer's photoeye is blocked by the book which is about to pas under the bar code printer.

If decision block 172 determines that the chainspace which is about to pass under the bar code printer does not contain a book which should be printed with a bar code, control passes to block 180. At block 180, a default message which does not contain a valid bar code sequence number is prepared; for example, the number "888" may be selected as the default message, since this number does not occur in the normal bar code numbering sequence. From block 180, control will pass to block 178 where the default message will be sent to the printer which will print the default message when the printer's photoeye is blocked.

After the message is sent to the printer from block 178, control passes back to decision block 152 which checks for the beginning of a cycle. From the time that the printer is sent a message to the beginning of the next cycle, one chainspace will pass under the printer. At that time, the printer's response will once again be ready to be analyzed at block 154 as previously described hereinabove.

Figure 16C:
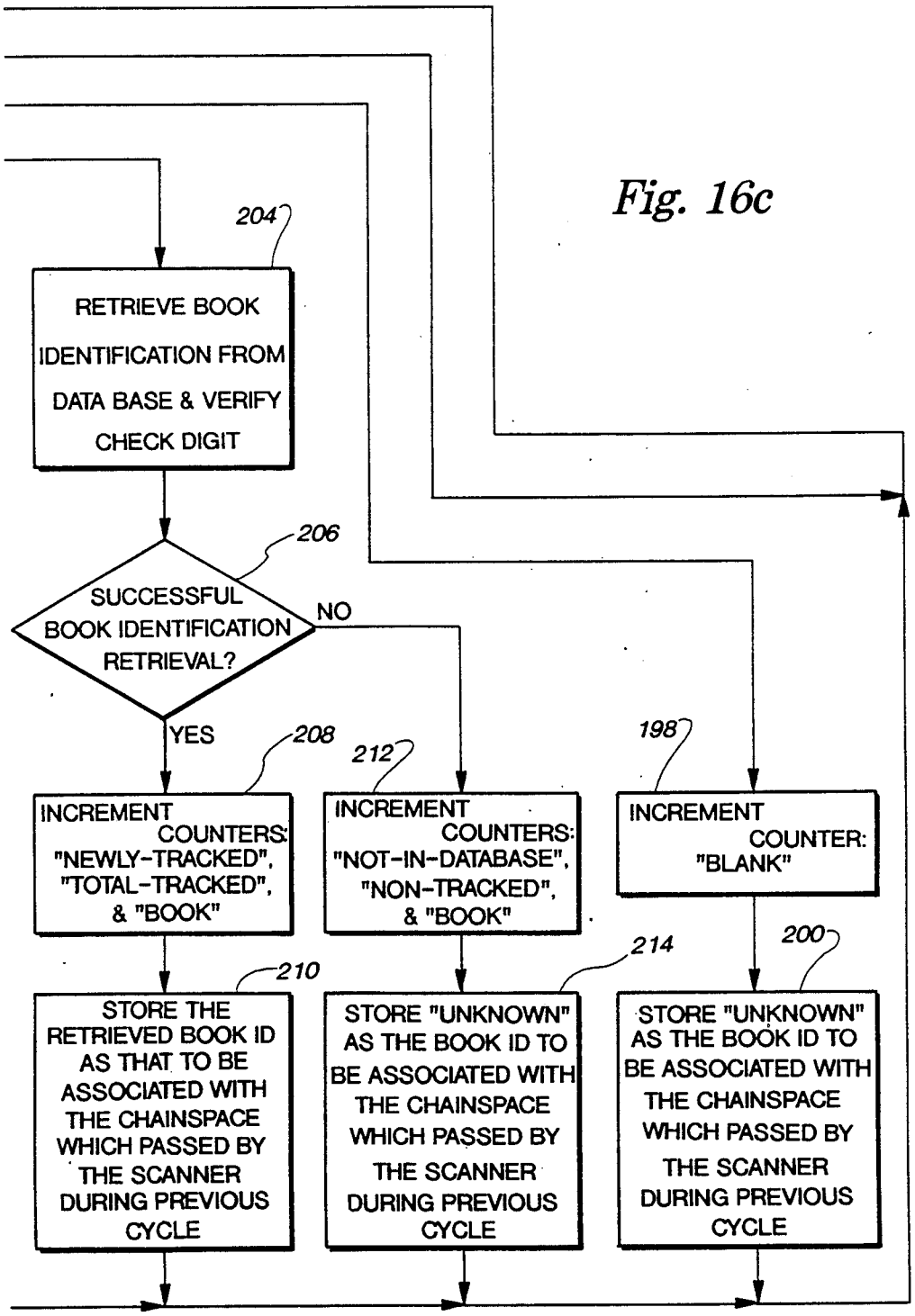
FIGS. 16, 16*a*, 16*b* and 16 *c* are a logic diagram of a bar code scanner control.

Referring to FIG. 16, the flow chart of the program which controls communication with each of the bar code scanners and performs the associated database operations is illustrated. Control begins at block 182 where the statistics counters are initialized and the scanner data buffer is cleared. From there, control passes to decision block 184 where a check is made to determine if the binding line is at the beginning of a cycle.

If the binding line is not at the beginning of a cycle, control passes back to decision block 184. This causes the program to wait for the beginning of a cycle. If the binding line is at the beginning of a cycle, decision block 184 passes control to block 186.

At block 186, a statistic counter "chainspace" which counts the number of chainspaces which have passed the bar code scanner is incremented. Control then passes to block 188 where the book identification associated with the previous chainspace (which is the chainspace which has just been scanned by the bar code scanner) is received by traditional means since the book identification may be directly associated to a chainspace. Next, control passes to decision block 190 which determines if the book identification which has just been retrieved for the chainspace is that of a known book.

If the book identification is already known, which is possible if the book has been identified by a previous scanner which operates in redundancy with this scanner, no use will be made of the data received from this bar code scanner and control will pass to block 192. At block 192, the statistic counters "previous-tracked", "total-tracked", and "book" are incremented. Respectively, these counters indicate the number of books which have been tracked prior to reaching this bar code scanner, the total number of books which have been tracked prior to reaching this bar code scanner or by this bar code scanner, and the number of valid books which have reached this bar code scanner.

Returning to decision block 190, if the book identification is not already known, control passes to block 194. At block 194, the content of the scanner data buffer is analyzed and control passes to decision block 196. If decision block 196 determines that there was no data received from the bar code scanner, control passes to block 198.

At block 198, the statistic counter "blank" is incremented. This counter indicates that the chainspace encountered must have been blank since the bar code scanner photoeye must not have been blocked by a book during the previous cycle in order for the bar code scanner not to send any data to the bar code scanner data buffer. From there, control passes to block 200.

At block 200, the book identification for the chainspace which passed by the bar code scanner during the previous cycle is marked as "unknown" since the presence of any book on this chainspace is undetermined.

Referring again to decision block 196, control passes to decision block 202 in the event there was data received from the bar code scanner. If decision block 202 determines that the data in the scanner data buffer represents a valid bar code sequence number, control passes to block 204. At block 204, the bar code sequence number read from the book is used to retrieve the book identification stored in the book tracking database. At block 204, the bar code sequence number is also used to verify the check digit associated with the reuse of database locations for multiple bar code sequence numbers. Control then passes to decision block 206 which determines if the book identification retrieval was successful both in terms of valid data being present in the book tracking database and a successfully verified check digit. If the book identification retrieval was successful, control passes to block 208.

At block 208, the statistic counters "newly-tracked", "total-tracked", and "book" are incremented. Respectively, these counters indicate the number of books which have been tracked by this bar code scanner, the total number of books which have been tracked prior to reaching this bar code scanner or by this bar code scanner, and the number of valid books which have reached this bar code scanner. Once the statistic counters at block 208 have been incremented, control passes to block 210.

At block 210, the book identification for the chainspace which passed by the bar code scanner during the previous cycle is marked with the book identification which was retrieved from the book tracking data base. And, although not explicitly shown, the book identification is removed from the book tracking database to prevent any possible further or additional retrieval of this information.

If the book identification retrieval was not successful at decision block 206, control passes to block 212 where the statistic counters "not-in-database", "non-tracked", and "book" are incremented. Respectively, these counters indicate the number of non-successful book identification retrievals from the book tracking database, the number of books which have not been tracked prior to reaching this bar code scanner or by this bar code scanner, and the number of valid books which have reached this bar code scanner. Next, control passes to block 214 where the book identification for the chainspace which passed by the bar code scanner during the previous cycle is marked as "unknown" since the book identification was not successfully retrieved from the book tracking database.

Control passes to decision block 216 in the event the bar code sequence number was determined to be invalid at decision block 202. If decision block 216 determines that the data in the scanner data buffer contains the phrase "no-read", control passes to block 218. The phrase "no-read" indicates that the bar code scanner read something, but was not able to properly decipher it as a valid bar code.

At block 218, the statistic counters "no-read", "non-tracked", and "book" are incremented. Respectively, these counters indicate the number of books which have contained a non-decipherable bar code, the number of books which have not been tracked prior to reaching this bar code scanner or by this bar code scanner, and the number of valid books which have reached this bar code scanner. After the statistic counters at block 218 have been incremented, control then passes to block 220.

At block 220, the book identification for the chainspace which passed by the bar code scanner during the previous cycle is marked as "unknown" since the bar code could not be deciphered by this bar code scanner.

If the bar code scanner data buffer does not contain the phrase "no-read" at decision block 216, control passes to decision block 222. Should decision block 222 determine that the data in the scanner data buffer is the default message, control passes to block 224. In this connection, the default message is that which is printed on books which were not desired to be tracked upon entering the physical subsystem.

At block 224, the statistic counter "unknown" is incremented. This counter indicates the number of books which passed by this scanner which were either unknown at the time at which they entered the physical subsystem, or were already marked to be rejected and reordered upon entering the physical subsystem thus making them non-desirable for tracking. From there, control passes to block 226

At block 226, the book identification for the chainspace which passed by the bar code scanner during the previous cycle is marked as "unknown" since the book identification for this book was never stored in the book tracking database.

If the bar code scanner data buffer does not contain the default message at decision block 222, control passes to block 228.

At block 228, the bar code scanner data buffer has been determined to contain bad data which corresponds neither to a valid bar code sequence number, the phrase "no-read", nor the default message, and the statistic counters "bad data", "non-tracked", and "book" are incremented. Respectively, these counters indicate the number of books which contained an incorrectly deciphered bar code, the number of books which have not been tracked prior to reaching this bar code scanner or by this bar code scanner, and the number of valid books which have reached this bar code scanner.

Next, control passes to block 230 where the book identification for the chainspace which passed by the bar code scanner during the previous cycle is marked as "unknown." This occurs since the book identification for this book could not be determined due to the corrupted bar code data which was received by the bar code scanner data buffer. After blocks 192, 200, 210, 214, 220, 226, and 230, control passe back to decision block 184 which checks for the beginning of a cycle. During the time of waiting for the next cycle, the bar code scanner data buffer will be updated with the bar code data contained on the book, if any, on the chainspace which passes under the bar code scanner during the remainder of this cycle.

In all of the foregoing discussion, reference to a "book" may be a magazine, catalog, or any other printed material. It should also be understood that reference to multi-book trimmer blades and associated devices is a particular example of any device or group of devices which do not allow for the direct association of one unique book to a particular chainspace. Further, reference to bar code and bar code scanner is merely a specific example of any machine readable symbology and the associated automated device to read that symbology, which besides bar code, could be optical character recognition, radio frequency, magnetic encoding and their respective deciphering technologies and the like. It should also be understood that reference to the bar code numbering sequence is a specific example of any series of numerics, or non-numerics, incorporated within any machine-readable symbology technology. Finally, reference to the database may be any interim storage means.

From the foregoing, it will also be appreciated that the present invention is also directed to a unique method of tracking books in a binding line. The method includes the steps of transporting books along a first binding line section to a book exit station, transferring books from the book exit station of the first binding line section to a book entry station of a second binding line section, and tracking books leaving the book exit station and books entering the book entry station through time and space. Further, the method includes the step of transporting books along the second binding line section from the book entry station.

With this understanding, books may be transported along the first binding line section in either asynchronous or synchronous relation to books being transported along the second binding line section. The books may also be transported along the first binding line section at the same speed as books being transported along the second binding line section or at a different, preferably lower speed, than books being transported along the second binding line section. Further, the books may be transported along two or more of the first binding line sections to the book exit station and/or two or more of the second binding line sections from the book entry station.

In a preferred form of the method, the books are mechanically transferred from the first binding line section or sections to the second binding line section or sections by utilizing a conveyor extending therebetween. The books are preferably electronically tracked by utilizing book detection means at or upstream of the book exit station of the first binding line section or sections and at or downstream of the book entry station of the second binding line section or sections. Preferably, the book detection means are electronically linked to a line controller so as to track books through time and space during the mechanical transferring step in a FIFO manner.

In one preferred form of the invention, the method includes the step of transporting books along the second binding line section or sections to a book exit station. It further includes the steps of mechanically transferring books from the book exit station of the second binding line section or sections to a book entry station of at least one third binding line section and electronically tracking books leaving the book exit station of the second binding line section or sections and books entering the book entry station of the third binding line section or sections through time and space. Additionally, the method includes the step of transporting books along the third binding line section or sections from the book entry station thereof.

With this understanding, the books may advantageously be mechanically transferred from the book exit station of the second binding line section or sections to the book entry station of the third binding line section or sections by utilizing a stacking trimmer subsystem extending therebetween. The method preferably then includes the step of electronically tracking books by providing each of the books with intrinsic book identification mean upstream of the book exit station of the second binding line section or sections to give a separate identification therefor. Further, the books preferably are electronically tracked by scanning the intrinsic book identification means at the book exit station of the second binding line section and at the book entry station of the third binding line section.

While in the foregoing there have been set forth preferred embodiments of the invention, variations in the details herein given may be made without departing from the true spirit and scope of the invention as defined by the appended claims.

We claim:

1. A binding line, comprising:

a first binding line section including means for transporting books therealong to a book exit station;

a second binding line section including means for transporting books therealong from a book entry station;

means for transporting books from said book exit station of said first binding line section to said book entry station of said second binding line section;

said first binding line section being asynchronously related to said second binding line section;

said means for transporting books along said second binding line section being independently operable relative to said means for transporting books along said first binding line section; and means associated with books leaving said book exit station and books entering said book entry station for tracking books through time and space between said first and second binding line sections.

2. The binding line as defined in claim 1 wherein said first binding line section is running at a different speed than said second binding line section.

3. The binding line as defined in claim 2 wherein said first binding line section is running at a lower speed than said second binding line section.

4. The binding line as defined in claim 2 wherein said first binding line section is running at a greater speed than said second binding line section.

5. The binding line as defined in claim 1 including two or more of said first binding line sections, each of said first binding line sections having means for transporting books therealong to said book exit station.

6. The binding line as defined in claim 1 including two or more of said second binding line sections, each of said second binding line sections having means for transporting books therealong from said book entry station.

7. The binding line as defined in claim 1 wherein said first binding line section is a gathering section and said second binding line section is a binder section.

8. The binding line as defined in claim 1 wherein said book transferring means includes a conveyor extending from said book exit station to said book entry station.

9. The binding line as defined in claim 1 wherein said book transferring means includes a shingling device between said book exit station and said book entry station.

10. The binding line as defined in claim 1 wherein said book transferring means includes a pile off station between said book exit station and said book entry station.

11. The binding line as defined in claim 1 wherein said book transferring means includes an intermediate storage device between said book exit station and said book entry station.

12. The binding line as defined in claim 1 wherein said first binding line section is a binder section and said second binding line section is a mail table section.

13. The binding line as defined in claim 1 wherein said book transferring means is a stacking trimmer subsystem between said book exit station and said book entry station.

14. The binding line as defined in claim 1 wherein said book tracking means includes book detection means at said book exit station and at said book entry station.

15. The binding line as defined in claim 1 wherein said book tracking means includes means associated with each of said books to provide a separate identification therefor.

16. A method of tracking books in a binding line, comprising the steps of:

transporting books along a first binding line section to a book exit station in an independently operable manner relative to a second binding line section;

transferring books from said book exit station of said first binding line section to a book entry station of said second binding line section;

tracking books leaving said book exit station and entering said book entry station through time and space between said first and second binding line sections; and transporting books along said second binding line section from said book entry station in an independently operable manner relative to said first binding line section;

said books being transported along said first binding line section in asynchronous relation to said books being transported along said second binding line section.

17. The book tracking method as defined in claim 16 wherein books are transported along said first binding line section at a different speed than books being transported along said second binding line section.

18. The book tracking method as defined in claim 17 wherein books are transported along said first binding line section at a lower speed than books being transported along said second binding line section.

19. The book tracking method as defined in claim 17 wherein books are transported along said first binding line section at a greater speed than books being transported along said second binding line section.

20. The book tracking method as defined in claim 16 wherein books are transported along two or more of said first binding line sections to said book exit station.

21. The book tracking method as defined in claim 16 wherein books are transported along two or more of said second binding line sections from said book entry station.

22. The book tracking method as defined in claim 16 wherein said book transferring step includes conveying books from said book exit station to said book entry station.

23. The book tracking method as defined in claim 16 wherein said book transferring step includes shingling books between said book exit station and said book entry station.

24. The book tracking method as defined in claim 16 wherein said book transferring step includes piling off books between said book exit station and said book entry station.

25. The book tracking method as defined in claim 16 wherein said book transferring step includes intermediately storing books between said book exit station and said book entry station.

26. The book tracking method as defined in claim 16 wherein said first binding line section is a gathering section and said second binding line section is a binder section.

27. The book tracking method as defined in claim 16 wherein said first binding line section is a binder section and said second binding line section is a mail table section.

28. The book tracking method as defined in claim 16 wherein said book transferring step includes passing books through a stacking trimmer subsystem between said book exit station and said book entry station.

29. The book tracking method as defined in claim 16 wherein said book tracking step includes detecting books at said book exit station and at said book entry station.

30. The book tracking method as defined in claim 16 wherein said book tracking step includes separately identifying each of said books at said book entry station from a separate identification therefor.

31. A method of tracking books in an asynchronous multi-section binding line, comprising the steps of:

transporting books along at least one first binding line section to a book exit station in an independently operable manner relative to at least one second binding line section;

mechanically transferring books from said book exit station of said first binding line section(s) to a book entry station of at least one of said second binding line section(s);

electronically tracking books leaving said book exit station and books entering said book entry station through time and space between said first and second binding line section(s); and transporting books along said second binding line section(s) from said book entry station thereof in an independently operable manner relative to said first binding line section(s).

32. The book tracking method as defined in claim 31 further including the steps of:

transporting books along said second binding line section(s) to a book exit station in an independently operable manner relative to at least one third binding line section;

mechanically transferring books from said book exit station of said second binding line section(s) to a book entry station of at least one of said third binding line sections;

electronically tracking books leaving said book exit station of said second binding line section(s) and books entering said book entry station of said third binding line section(s) through time and space between said second and third binding line section(s); and transporting books along said third binding line section(s) from said book entry station thereof in an independently operable manner relative to said second binding line section(s).

33. The book tracking method as defined in claim 32 wherein the step of mechanically transferring books from said book exit station of said second binding line section(s) to said book entry station of said third binding line section(s) is performed by passing books through a stacking trimmer subsystem disposed therebetween.

34. The book tracking method as defined in claim 32 wherein the step of electronically tracking books is performed by providing each of said books with intrinsic book identification means upstream of or at said book exit station of said second binding line section(s) to give a separate identification therefor.

35. The book tracking method as defined in claim 34 wherein the step of electronically tracking books is further performed by identifying said intrinsic book identification means at or downstream of said book entry station of said third binding line section(s).

36. The book tracking method as defined in claim 35 wherein said intrinsic book identification means is a code and said identifying step includes reading said code at said book entry station of said third binding line section(s).

37. The book tracking method as defined in claim 36 wherein said code is a bar code and said identifying step is performed by a bar code reader and including the step of printing said bar code on said books upstream of or at said book exit station of said second binding line section(s).

38. The book tracking method as defined in claim 32 wherein said second binding line section(s) is a binder section(s) and said third binding line section(s) is a mail table section(s).

39. The book tracking method as defined in claim 31 wherein the step of mechanically transferring books from said book exit station of said first binding line section(s) to said book entry station of said second binding line section(s) is performed by conveying said books.

40. The book tracking method as defined in claim 31 wherein the step of mechanically transferring books from said book exit station of said first binding line section(s) to said book entry station of said second binding line section(s) is performed by shingling said books.

41. The book tracking method as defined in claim 31 wherein the step of mechanically transferring books from said book exit station of said first binding line section(s) to said book entry station of said second binding line section(s) is performed by piling off said books.

42. The book tracking method as defined in claim 31 wherein the step of mechanically transferring books from said book exit station of said first binding line section(s) to said book entry station of said second binding line section(s) is performed by intermediately storing said books.

43. The book tracking method as defined in claim 31 wherein the step of electronically tracking books is performed by detecting books at said book exit station of said first binding line section(s) and at said book entry station of said second binding line section(s).

44. The book tracking method as defined in claim 43 wherein the step of electronically tracking books is further performed by electronically linking said book detection at said book exit station and said book entry station to a line controller to track books through time and space in a FIFO manner.

45. The book tracking method as defined in claim 44 wherein said book detecting step includes redundantly cross-firing photoeyes located at said book exit station of said first binding line section(s) and at said book entry station of said second binding line section(s).

46. The book tracking method as defined in claim 38 wherein said first binding line section(s) is a gathering section(s) and said second binding line section(s) is a binder section(s).

47. The book tracking method as defined in claim 31 including the step of detecting errors associated with said first binding line section(s), said second binding line section(s), said mechanical book transferring step and said electronic book tracking step.

48. The book tracking method as defined in claim 47 wherein said error detecting step includes detecting a mechanical error during said mechanical book transferring step and stopping the steps of transporting books along said first binding line section(s) and said second binding line section(s).

49. The book tracking method as defined in claim 48 wherein said mechanical error detecting step includes detecting a book jam during said mechanical book transferring step.

50. The book tracking method as defined in claim 48 wherein said mechanical error detecting step includes detecting book removal during said mechanical book transferring step.

51. The book tracking method as defined in claim 48 wherein said mechanical error detecting step includes detecting a transfer housing-opened condition during said mechanical book transferring step.

52. The book tracking method as defined in claim 47 wherein said error detecting step includes detecting an electronic error during said electronic book tracking step and stopping the steps of transporting books along said first binding line section(s) and said second binding line section(s).

53. The book tracking method as defined in claim 52 wherein said electronic error detecting step includes detecting an electronic tracking overflow condition during said electronic book tracking step.

54. The book tracking method as defined in claim 52 wherein said electronic error detecting step includes detecting an electronic tracking underflow condition during said electronic book tracking step.

55. The book tracking method as defined in claim 52 wherein said electronic error detecting step includes detecting a missing book eye signal during said electronic book tracking step.

56. The book tracking method as defined in claim 52 wherein said electronic error detecting step includes detecting an inconsistent book eye signal during said electronic book tracking step.

57. An asynchronous multi-section binding line, comprising:

at least one first binding line section including means for transporting books therealong to a book exit station;

at least one second binding line section including means for transporting books therealong from a book entry station;

mechanical means for transferring books from said book exit station of said first binding line section to said book entry station of said second binding line section;

said means for transporting books along said second binding line section(s) being independently operable relative to said means for transporting books along said first binding line section(s); and electronic means associated with books leaving said book exit station and books entering said book entry station for tracking books through time and space between said first and second binding line sections.

58. The asynchronous multi-section binding line as defined in claim 57 wherein said mechanical book transferring means includes a conveyor extending from said book exit station to said book entry station.

59. The asynchronous multi-section binding line as defined in claim 57 wherein said mechanical book transferring means includes a shingling device between said book exit station and said book entry station.

60. The asynchronous multi-section binding line as defined in claim 57 wherein said mechanical book transferring means includes a pile off station between said book exit station and said book entry station.

61. The asynchronous multi-section binding line as defined in claim 57 wherein said mechanical book transferring means includes an intermediate storage device between said book exit station and said book entry station.

62. The asynchronous multi-section binding line as defined in claim 57 wherein said mechanical book transferring means is a stacking trimmer subsystem between said book exit station and said book entry station.

63. The asynchronous multi-section binding line as defined in claim 57 wherein said electronic book tracking means includes book detection means at said book exit station and at said book entry station.

64. The asynchronous multi-section binding line as defined in claim 63 wherein said book detection means are electronically linked to a line controller to track books through time and space in a FIFO manner.

65. The asynchronous multi-section binding line as defined in claim 63 wherein said book detection means includes redundant cross-firing photoeyes located at said book exit station and at said book entry station.

66. The asynchronous multi-section binding line as defined in claim 57 wherein said electronic book tracking means includes intrinsic book identification means associated with each of said books to provide a separate identification therefor.

67. The asynchronous multi-section binding line as defined in claim 66 wherein said intrinsic book identification means is associated with each of said books upstream of or at said book exit station and including means for identifying said intrinsic book identification means at or downstream of said book entry station.

68. The asynchronous multi-section binding line as defined in claim 67 wherein said intrinsic book identification means is a code and said identifying means includes means for reading said code at or downstream of said book entry station.

69. The asynchronous multi-section binding line as defined in claim 68 wherein said code is a bar code and said code reading means is a bar code reader, said intrinsic book identification means also including a bar code printer upstream of or at said book exit station for printing said bar code on each of said books.

70. The asynchronous multi-section binding line as defined in claim 57 including error detection means associated with said first and second binding line sections, said mechanical book transferring means and said electronic book tracking means.

71. The asynchronous multi-section binding line as defined in claim 70 wherein said error detection means includes means for detecting a mechanical error in said mechanical book transferring means and stopping said book transporting means of said first and second binding line sections.

72. The asynchronous multi-section binding line as defined in claim 71 wherein said mechanical error detection means includes a book jam detector.

73. The asynchronous multi-section binding line as defined in claim 71 wherein said mechanical error detection means includes a transfer book removal detector.

74. The asynchronous multi-section binding line as defined in claim 71 wherein said mechanical error detection means includes a transfer housing-opened detector.

75. The asynchronous multi-section binding line as defined in claim 70 wherein said error detection means includes means for detecting an electronic error in said electronic book tracking means and stopping said book transporting means of said first and second binding line sections.

76. The asynchronous multi-section binding line as defined in claim 75 wherein said electronic error detection means includes an electronic tracking overflow detector.

77. The asynchronous multi-section binding line as defined in claim 75 wherein said electronic error detection means includes an electronic tracking underflow detector.

78. The asynchronous multi-section binding line as defined in claim 75 wherein said electronic error detection means includes a missing book eye signal detector.

79. The asynchronous multi-section binding line as defined in claim 75 wherein said electronic error detection means includes an inconsistent book eye signal detector.

80. The asynchronous multi-section binding line as defined in claim 57 wherein said electronic book tracking means is operatively independent of said mechanical book transferring means.

81. An asynchronous multi-section binding line, comprising:

a first binding line section including means for transporting books therealong to a book exit station;

first mechanical means for transferring books from said book exit station of said first binding line section to a book entry station of a second binding line section;

first electronic means associated with books leaving said book exit station of said first binding line section and books entering said book entry station of said second binding line section for tracking books through time and space between said first and second binding line sections;

said second binding line section including means for transporting books therealong to a book exit station;

said means for transporting books along said second binding line section being independently operable relative to said means for transporting books along said first binding line section;

second mechanical means for transferring books from said book exit station of said second binding line section to a book entry station of a third binding line section; and second electronic means associated with books leaving said book exit station of said second binding line section and books entering said book entry station of said third binding line section for tracking books through time and space between said second and third binding line sections;

said third binding line section including means for transporting books therealong to a book exit station;

said means for transporting books along said third binding line section being independently operable relative to said means for transporting books along said second binding line section.

82. The asynchronous multi-section binding line as defined in claim 81 wherein said first binding line section is a gathering section and said second binding line section is a binder section, said first mechanical book transferring means including a conveyor extending -from said book exit station of said gathering section to said book entry station of said binder section.

83. The asynchronous multi-section binding line as defined in claim 81 wherein said second binding line section is a binder section and said third binding line section is a mail table section, said second mechanical book transferring means including a stacking trimmer subsystem extending from said book exit station of said binder section to said book entry station of said mail table section.

84. The asynchronous multi-section binding line as defined in claim 81 wherein at least one of said first and second mechanical book transferring means includes a shingling device.

85. The asynchronous multi-section binding line as defined in claim 81 wherein at least one of said first and second mechanical book transferring means includes a pile off station.

86. The asynchronous multi-section binding line as defined in claim 81 wherein at least one of said first and second mechanical book transferring means includes an intermediate storage device.

87. The asynchronous multi-section binding line as defined in claim 81 wherein said first electronic book tracking means includes book detection means at said book exit station of said first binding line section and at said book entry station of said second binding line section.

88. The asynchronous multi-section binding line as defined in claim 87 wherein said book detection means are electronically linked to a line controller to track books through time and space in a FIFO manner.

89. The asynchronous multi-section binding line as defined in claim 88 wherein said book detection means includes redundant cross-firing photoeyes located at said book exit station of said first binding line section and at said book entry station of said second binding line section.

90. The asynchronous multi-section binding line as defined in claim 81 wherein said second electronic book tracking means includes intrinsic book identification means associated with each of said books to provide a separate identification therefor.

91. The asynchronous multi-section binding line as defined in claim 90 wherein said intrinsic book identification means is associated with each of said books upstream of or at said book exit station of said second binding line section and including means for identifying said intrinsic book identification means at or downstream of said book entry station of said third binding line section.

92. The asynchronous multi-section binding line as defined in claim 91 wherein said intrinsic book identification means is a code and said identifying means includes means for reading said code at or downstream of said book entry station of said third binding line section.

93. The asynchronous multi-section binding line as defined in claim 92 wherein said code is a bar code and said code reading means is a bar code reader, said intrinsic book identification means also including a bar code printer at or upstream of said book exit station of said second binding line section.

94. The asynchronous multi-section binding line as defined in claim 81 including error detection means associated with at least said first and second binding line sections, said first mechanical book transferring means and said first electronic book tracking means.

95. The asynchronous multi-section binding line as defined in claim 94 wherein said error detection means includes means for detecting a mechanical error in said first mechanical book transferring means and stopping said book transporting means of said first and second binding line sections.

96. The asynchronous multi-section binding line as defined in claim 95 wherein said mechanical error detection means includes a book jam detector.

97. The asynchronous multi-section binding line as defined in claim 95 wherein said mechanical error detection means includes a transfer book removal detector.

98. The asynchronous multi-section binding line as defined in claim 95 wherein said mechanical error detection means includes a transfer housing-opened detector.

99. The asynchronous multi-section binding line as defined in claim 94 wherein said error detection means includes means for detecting an electronic error in said first electronic book tracking means and stopping said book transporting means of said first and second binding line sections.

100. The asynchronous multi-section binding line as defined in claim 99 wherein said electronic error detection means includes an electronic tracking overflow detector.

101. The asynchronous multi-section binding line as defined in claim 99 wherein said electronic error detection means includes an electronic tracking underflow detector.

102. The asynchronous multi-section binding line as defined in claim 99 wherein said electronic error detection means includes a missing book eye signal detector.

103. The asynchronous multi-section binding line as defined in claim 99 wherein said electronic error detection means includes an inconsistent book eye signal detection means includes an inconsistent book eye signal detector.

* * * * *